US007264582B2

(12) United States Patent
Thuesen et al.

(10) Patent No.: US 7,264,582 B2
(45) Date of Patent: Sep. 4, 2007

(54) POUCH CONTAINERS HAVING ADVERTISING MEDIA AND METHODS FOR THEIR DISSEMINATION

(75) Inventors: Marcus L. Thuesen, Houston, TX (US); Lejo C. Brana, Houston, TX (US)

(73) Assignee: 2004Adploy Limited Partnership, Houston, TX (US)

( * ) Notice: Subject to any disclaimer, the term of this patent is extended or adjusted under 35 U.S.C. 154(b) by 101 days.

(21) Appl. No.: 10/798,760

(22) Filed: Mar. 11, 2004

(65) Prior Publication Data

US 2006/0157370 A1 Jul. 20, 2006

(51) Int. Cl.
*B31B 1/88* (2006.01)
*B42D 15/00* (2006.01)
*G09F 23/00* (2006.01)
*B65D 85/00* (2006.01)

(52) U.S. Cl. ..... 493/187; 283/67; 283/81; 40/637; 206/459.5

(58) Field of Classification Search ..... 206/459.5, 206/232, 484, 831; 283/81, 105, 67; 40/124.06, 40/637, 674; 383/200, 204, 207, 209; 229/87.05, 229/87.08, 87.09, 87.11; 493/186–189, 243, 493/254

See application file for complete search history.

(56) References Cited

U.S. PATENT DOCUMENTS 3,386,645 A * 6/1968 Powell ..... 383/106
4,007,577 A * 2/1977 Matthews et al. ..... 53/570
4,478,858 A * 10/1984 Baird et al. ..... 206/484
4,516,793 A 5/1985 Kiyokane ..... 283/103
4,908,761 A 3/1990 Tai ..... 364/401
5,011,466 A 4/1991 DeMatteis et al. ..... 493/188
5,035,515 A 7/1991 Crossman et al. ..... 383/38
5,157,902 A * 10/1992 Hatakeyama ..... 53/492
5,230,423 A 7/1993 Gellatly ..... 206/45.14
5,341,930 A 8/1994 Counts et al. ..... 206/459.5
5,487,203 A 1/1996 Brach, Jr. et al. ..... 15/245
5,555,991 A 9/1996 Hart ..... 211/73

(Continued)

FOREIGN PATENT DOCUMENTS

EP 0231882 A2 8/1987

(Continued)

*Primary Examiner*—Mickey Yu
*Assistant Examiner*—J. Gregory Pickett
(74) *Attorney, Agent, or Firm*—Keith B Willhelm

(57) ABSTRACT

Improved methods of disseminating advertising messages to consumers are provided for. In particular, the subject invention provides for methods for disseminating manufacturer coupons to a target consumer group. The method comprises packaging a product in a pouch container having associated therewith a manufacturer coupon pertaining to products or services other than the packaged product. The packaged product is a single-serve food product. The manufacturer coupon is redeemable by a consumer of the product and a member of a target consumer group. The manufacturer coupon also includes machine readable code associated therewith to facilitate automated processing of the coupon. The packaged product is then packaged in a shipping carton. The shipping carton has a machine readable indicator assigned to the manufacturer coupon. The indicator is read and, in response thereto, the carton with the packaged product is shipped to consumer food service outlets associated with the target consumer group. The packaged single-serve food product and the manufacturer coupon thereby may be distributed to consumers and, in particular, members of the target consumer group.

25 Claims, 10 Drawing Sheets

U.S. PATENT DOCUMENTS

| | | | | |
|---|---|---|---|---|
| 6,007,264 | A | 12/1999 | Koptis | 401/132 |
| 6,073,372 | A | 6/2000 | Davis | 40/124.16 |
| 6,094,886 | A | 8/2000 | Poignant | 53/412 |
| 6,199,698 | B1 | 3/2001 | Hetrick et al. | 206/532 |
| 6,305,531 | B1 | 10/2001 | Wilkman | 206/210 |
| 6,421,986 | B1 | 7/2002 | Dharssi | 53/474 |
| 6,594,927 | B2 | 7/2003 | Witkowski | 40/310 |
| 6,612,059 | B2 | 9/2003 | Cochran et al. | 40/673 |
| 6,786,515 | B2 * | 9/2004 | Franko, Sr. | 283/81 |
| 2004/0010448 | A1 * | 1/2004 | Miller, III. | 705/14 |
| 2005/0086910 | A1 * | 4/2005 | Chambers et al. | 206/526 |

FOREIGN PATENT DOCUMENTS

| | | | | |
|---|---|---|---|---|
| EP | 0340817 | A1 | | 11/1989 |
| EP | 02-057564 | | | 2/1990 |
| EP | 11-059772 | | | 3/1999 |
| EP | 1026088 | A1 | | 8/2000 |
| EP | 2002-145281 | | | 5/2002 |
| FR | 2422562 | | | 11/1979 |
| GB | 2240758 | A | * | 8/1991 |
| JP | 02-057564 | | | 2/1990 |
| JP | 11-059772 | | | 3/1999 |
| JP | 2002-145281 | | | 5/2002 |
| WO | WO 01/34483 | A1 | | 5/2001 |

* cited by examiner

POUCH CONTAINERS HAVING ADVERTISING MEDIA AND METHODS FOR THEIR DISSEMINATION

FIELD OF THE INVENTION

The present invention relates to pouch containers for products and to methods for disseminating advertising messages, and more particularly, to improved pouch containers having separable advertising media and to methods for disseminating advertising messages to consumers via such improved pouch containers.

BACKGROUND OF THE INVENTION

Advertisers have relied on many different ways to deliver advertising messages. For example, many advertisements are delivered through broadcast mass media, such as radio and television, or through printed mass media, such as magazines and newspapers. Direct advertising is another popular and often highly effective method because messages are delivered directly to a defined population of consumers. In addition to direct mail and e-mails, other direct advertising methods include dimensional mail, catalogs, inserts in bills and other mailings.

Despite the many different media available to advertisers, however, there is a continuing need to develop effective, cost efficient methods of advertising. For example, while distribution by broadcast media is relatively inexpensive, the cost of producing entertainment, news and other content for broadcast media can be extremely expensive, and those costs are reflected in advertising fees. Content production costs for printed mass media also can be substantial, and printed mass media can be expensive to produce and distribute. While most direct advertising contains little or no content beyond the advertising message, and thus, involves relatively low content cost, the cost of direct advertising nevertheless can be substantial. Such costs typically include the generation of a mailing list and postage or other delivery costs.

Moreover, a substantial portion if not the majority of all advertising messages are never viewed by their intended audience for one reason or another. Many consumers receiving the advertisement may have no interest in the advertised good or service, or they may not be able to afford it. There also is a general clutter of advertisements that makes it difficult for a particular ad to capture the attention of consumers, especially if the consumer is distracted or otherwise occupied when the opportunity for viewing the ad arises.

For example, response rates for radio and television advertising typically is under 1%. Although inserts in newspapers and magazines commonly have somewhat higher response rates on the order of 1-2%, newspaper and magazine advertisements also have very low response rates, usually under 1%. Direct mail, catalogs, and e-mails have average response rates around 2%. The response rates for all of these methods, however, are greatly reduced because the vast majority of the ads are never viewed. For example, most direct mailings are thrown away without ever being opened. Likewise, from 85 to 99% of e-mailings are never opened.

Thus, most advertising methods are very inefficient and wasteful. The effective cost for each advertising message that is actually communicated to consumers, therefore, is generally many times higher that the nominal cost per message. Thus, despite, and in part because of the number and variety of conventional methods, advertisers continue to seek more cost effective ways of disseminating advertising messages.

Some methods of direct advertising that have shown both significant promise and significant shortcomings utilize the product itself as a distribution vehicle. For example, in "cross ruffing" a noncompetitive product is used as the vehicle to distribute a coupon, sample, or other sales promotion offer for another product. Coupons, premiums, and rebates toward the purchase of the same or another product also are attached to or included in product packaging as part of so-called "bounce back" offers. That is, packaging for products has long presented advertising messages relating to the products that are contained therein along with whatever other product information that may be required by law. More recently, however, products have been distributed in packaging that includes and presents advertising messages and incentives for products other than that contained in the package or that will incentivize the consumer to purchase more of the same product. The messages typically have been imprinted on the packaging itself, carried in the packaging along with the product, or removably affixed to the packaging.

Cross ruffing and bounce back advertising messages on carrier products have a significant cost advantage over other forms of direct advertising because the distribution of such messages is in a sense nearly cost free. That is, other than the cost of printing or otherwise preparing the advertising message itself, there is little incremental cost in disseminating cross ruffed and bounce back advertising messages over and above the cost of producing and distributing the carrier products themselves.

Accordingly, cross ruffed and bounce back advertising messages on certain products have become common, for example, on cereal packaging. Many people place the box on the table while they eat breakfast cereals. Although they may be reading a newspaper, televisions may be on, or there may be other activities diverting their attention, this provides a greater opportunity for consumers to view advertising messages carried on or in cereal packaging. Accordingly, advertising messages carried on cereal packaging can have a higher view rate than other forms of direct advertising.

Despite the advantages of presenting an advertising message directly to a target audience, and despite its significant cost advantage over other forms of direct advertising, the type of products and packaging utilized to carry cross ruffed and bounce back advertising messages has been limited. In some instances this may be because certain products are not consumed under circumstances conducive to viewing of advertising messages. In other instances advertisers may fail to appreciate the opportunities created during consumption of the product. On the other hand, some products are consumed under circumstances that appear to provide ideal environments for delivering an advertising message, yet their use as carrier products has been extremely limited or non-existent.

Fortune cookies, for example, have a message slip baked into the cookie that is almost universally viewed, thus ensuring that any advertising message carried thereon would be effectively delivered as well. The relatively small size of traditional fortune cookie inserts, however, does not provide space for delivering much more than a branding type message, and fortune cookie inserts to date have proven unsuitable for delivering more extensive and sophisticated advertising messages.

Many so called "single-serve" food products are consumed under circumstances that also appear to provide favorable environments for presenting consumers with an opportunity to view advertising messages. Such single-serve products include a variety of condiments, such as sugar, sugar substitutes, ketchup, relish, and sauces, which are provided to consumers in restaurants, concessions, institutions, and other food service outlets. Such consumers frequently have many opportunities to view advertising messages while they are waiting for their food or eating it.

To date, however, single-serve products have not been used or used effectively as vehicles to deliver advertising messages. One of the most common types of packaging for such products is so-called "pouch" or "sachet" containers. They are fabricated from sheets of various papers and films that are formed most commonly into generally rectangular "pillow" shapes, the interior volume of which holds the product. They are commonly divided into two general types: three and four-sided seals.

Three-sided seal pouch containers comprise a single, generally rectangular sheet that is folded in half. Seals are then formed in what may be viewed as the top and side edges of the pouch, those three seals and the fold defining a sealed volume in which product is disposed. There also are "wrap" style three-sided seal pouches. Such pouches comprise a generally rectangular sheet that is folded twice. Seals are formed in two opposing side edges. The third seal is formed on one of the faces, as opposed to the edge, of the pouch. Four-sided seal pouch containers comprise two, superimposed, generally rectangular sheets that are sealed together on all four edges. In addition to the most common pillow shape, there are also gusset bottom and stand-up pouch containers, and extensions from the top of pouch containers have been provided with holes to facilitate display of the packaged product.

The sheets from which pouch containers are fabricated typically are composed of an imprintable substrate that is well suited for presenting advertising and information relating to the packaged product. To date, however, pouch containers, especially those used to package single-serve food products, have not been used extensively, if at all, as carriers for cross ruffed and bounce back advertising messages.

One problem is that the serving size of many of products is relatively small, meaning that the pouch container for such products also is relatively small. For example, sugar packets typically are approximately 1.75" by 3.75", or somewhat smaller. Ketchup packets and packets for other sauces typically are approximately 2.0" by 3.75", or somewhat smaller. There is a limited amount of imprintable space, much of which must be devoted to product information required by law or good business practice. Typically any advertising messages are limited to relatively simple branding messages and such messages usually pertain to the packaged product. There is very little room for more sophisticated and complex advertising messages that are essential to successful marketing campaigns.

In particular, many products, such as food and consumer household products, are promoted extensively using manufacturer coupons. Such coupons typically offer a discount on specifically identified products and are distributed to consumers through various media such as newspapers and direct mailings. Consumers may redeem the coupons with merchants selling the product. The merchants in turn are reimbursed by the manufacturer or distributor of the product. The vast majority of manufacturer coupons are redeemed by merchants through a clearing house such as NCH Marketing Services, Deerfield, Ill. The automated processing of such manufacturer coupons essentially requires that they incorporate machine readable indicia, such as UPC bar codes utilizing the UCC/EAN-128 Article Numbering System. Information on standards for manufacturer coupons is publicly available, for example, through Uniform Code Council, Inc., Lawrenceville, N.J., and through Grocery Manufacturers of America, Inc., Washington, D.C.

Manufacturer coupons have been distributed using various types of product packaging as a carrier. For example, such coupons commonly are carried inside or imprinted on carton containers used to package cereal and other food products. The carton containers for such products typically are quite large and can easily accommodate manufacture coupons. Many pouch containers commonly used in packaging single-serve products, however, are as a practical matter too small to accommodate a bar code and even minimal product identification as is required to produce a consumer redeemable, manufacturer coupon.

An object of this invention, therefore, is to provide improved methods for directly disseminating advertising messages to consumers of food and other types of products and improved packaging for products providing a medium for delivery of advertising messages.

It also is an object to provide such improved methods and packaging capable of delivering more extensive and sophisticated advertising messages, such as redeemable manufacturer coupons, especially such methods and packaging that may be used to advantage in single-serve food products.

Another object of this invention is to provide improved packaging having increased imprintable surface area, and especially such packaging that may be used to advantage in single-serve food products.

It also is a more specific object of the subject invention to provide improved pouch packaging, and especially pouch packaging for single-serve and other relatively small pouch packages, that is capable of delivering more extensive and sophisticated advertising messages, such as redeemable manufacturer coupons.

Yet another object is to provide such improved packaging that may be produced by conventional machinery and processes with little or no modification.

It is a further object of this invention to provide such methods and packaging wherein all of the above-mentioned advantages are realized.

Those and other objects and advantages of the invention will be apparent to those skilled in the art upon reading the following detailed description and upon reference to the drawings.

SUMMARY OF THE INVENTION

The subject invention provides for improved methods of disseminating advertising messages to consumers. In particular, the subject invention provides for methods for disseminating manufacturer coupons to a target consumer group. The method comprises packaging a product in a pouch container having associated therewith a manufacturer coupon pertaining to products or services other than the packaged product. The packaged product is a single-serve food product. The manufacturer coupon is redeemable by a consumer of the product and a member of a target consumer group. The manufacturer coupon also includes machine readable code associated therewith to facilitate automated processing of the coupon.

The packaged product is then packaged in a shipping carton. The shipping carton has a machine readable indicator assigned to the manufacturer coupon. The indicator is read and, in response thereto, the carton with the packaged product is shipped to consumer food service outlets associated with the target consumer group. The packaged single-serve food product and the manufacturer coupon thereby may be distributed to consumers and, in particular, members of the target consumer group.

The methods also utilize novel pouch packages for products that are constructed in accordance with the subject invention and selected from the groups consisting of any or all of the novel packages. The packaged product with the advertising message is distributed to a consumer outlet and then to consumers associated with the consumer outlet. Preferably, the product is a single-serve food product which is distributed to food service establishments.

The novel pouch packages provided for by the subject invention comprise one or more flexible imprintable substrate sheets. The substrate sheets comprise collectively one or more pouch sections defining a sealed volume accommodating a product therein and a message section providing a substrate on which a message may be imprinted. The pouch sections are provided on one or more of the substrate sheets. The messages section is provided on one of the same substrate sheets or another substrate sheet. The message section is connected to at least one of the pouch sections defining the sealed volume, but is separable from the pouch sections without compromising the integrity of the sealed volume. Thus, the advertising message may be removed from the sealed volume and viewed by a consumer.

The novel pouch containers comprise various embodiments, including pouch containers wherein the message section extends from one or more of the seals defining the pouch and where the message section is laminated or otherwise affixed to a face of the pouch. Other preferred embodiments comprise single-serve, especially single-serve food products packaged in the novel containers, and novel containers having relatively small pouches, but with significantly greater area available for imprinting advertising messages. The novel pouch containers also include preferred embodiments having a manufacturer coupon imprinted on the message section that is redeemable by a consumer of the packaged product and that has imprinted thereon machine readable indicia to facilitate automated processing of the coupon. Preferably the machine readable indicia are a UPC bar code utilizing the UCC/EAN-128 Article Numbering System or another bar code.

It will be appreciated that products when packaged in the novel pouch containers will occupy substantially the same space as when they are packaged in conventional pouch containers, yet the novel packaging will provide significantly greater area on which advertising messages may be imprinted. Moreover, by increasing the imprintable area of the packaging without significantly increasing the overall size of the packaged product, more extensive and sophisticated advertising messages may be provided even in relatively small pouch containers. In particular, the novel containers, even when they are sized to package relatively small single-serve products such as sugar and sauces, have sufficient imprintable surface area to accommodate a manufacturer coupon, including the requisite product information and machine readable bar code used in systems that manage accounting between coupon issuers and merchants. It also will be appreciated that the cost of providing message sections in the novel pouch containers is minimal compared to the value of the advertising and that the advertising messages may be effectively disseminated for little incremental cost over the normal costs of producing and distributing the packaged product.

DESCRIPTION OF ILLUSTRATIVE EMBODIMENTS

The subject invention is directed to product packaged in improved pouch containers. The improved pouch containers comprise one or more flexible imprintable substrate sheets. Collectively, the substrate sheets comprise one or more pouch sections that define a sealed volume accommodating a product. The pouch sections are be provided on one or more of the substrate sheets. The substrate sheets also provide a message section. The message section provides a substrate on which a message may be imprinted. The message section is provided on one of the substrate sheets, either on a separate substrate sheet or on one of the substrate sheets having a pouch section, and is connected to at least one of the pouch sections. It is separable from the pouch sections without compromising the integrity of the sealed volume, whereby a message, such as an advertising message, may be removed from the container and viewed by a consumer.

Various preferred embodiments of the novel invention include a product packaged in a pouch container comprising a flexible imprintable substrate sheet. The substrate sheet comprises one or more pouch sections and at least one message section adjacent to a pouch section. The substrate sheet is folded such that the boundaries of the pouch sections overlap. The boundaries of the pouch sections are sealed together to define a sealed volume accommodating the product therein with the message section extending from a sealed boundary of the pouch sections. The message section provides a substrate on which an advertising message may be imprinted and viewed by a consumer of the product, and it is separable from the pouch sections and the sealed volume defined by the pouch section without compromising the integrity of the sealed volume.

For example, and in accordance with a first preferred embodiment, the novel pouch container is fabricated from a flexible imprintable substrate sheet comprising a single, rectangular pouch section and a message section extending from a boundary thereof. The substrate sheet is folded in half along a line passing through the pouch section parallel to the boundary from which the message section extends to provide two rectangular, overlaid folds. The boundaries of the pouch section are sealed to define a generally rectangular-shaped sealed volume having a top seal opposite the fold line and side seals. The message section extends from the top seal of the sealed volume opposite the fold line.

Figure 1:
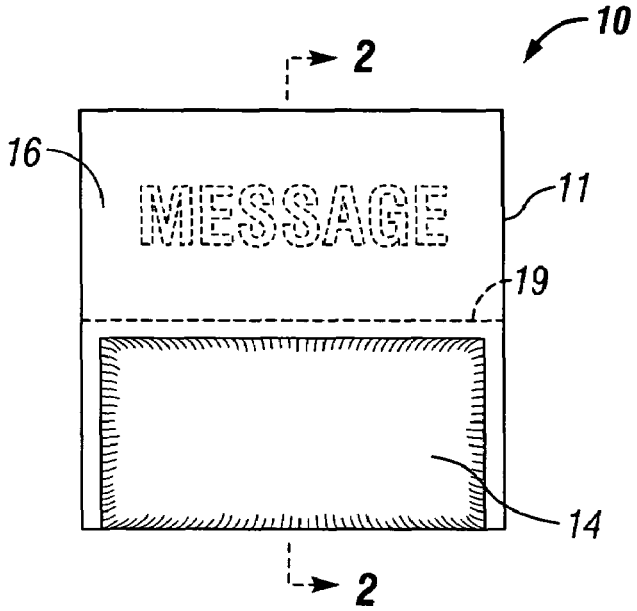
FIG. 1 is a top plan view of a first preferred embodiment 10 of the pouch containers of the subject invention, which container 10 comprises two separable imprintable message sections extending from the top seal of a three-sided seal pouch and providing media for advertising messages.
Figure 2:
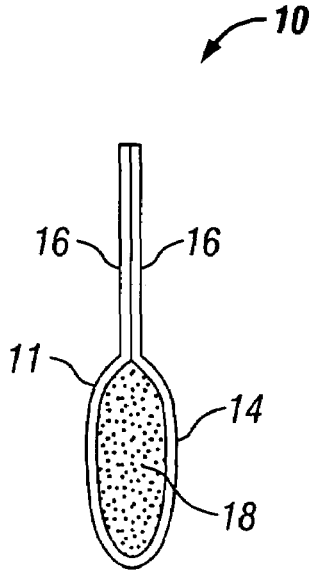
FIG. 2 is a cross-sectional view of the novel pouch container 10 shown in FIG. 1 taken along line 2-2 thereof showing the construction of container 10.
Figure 3:
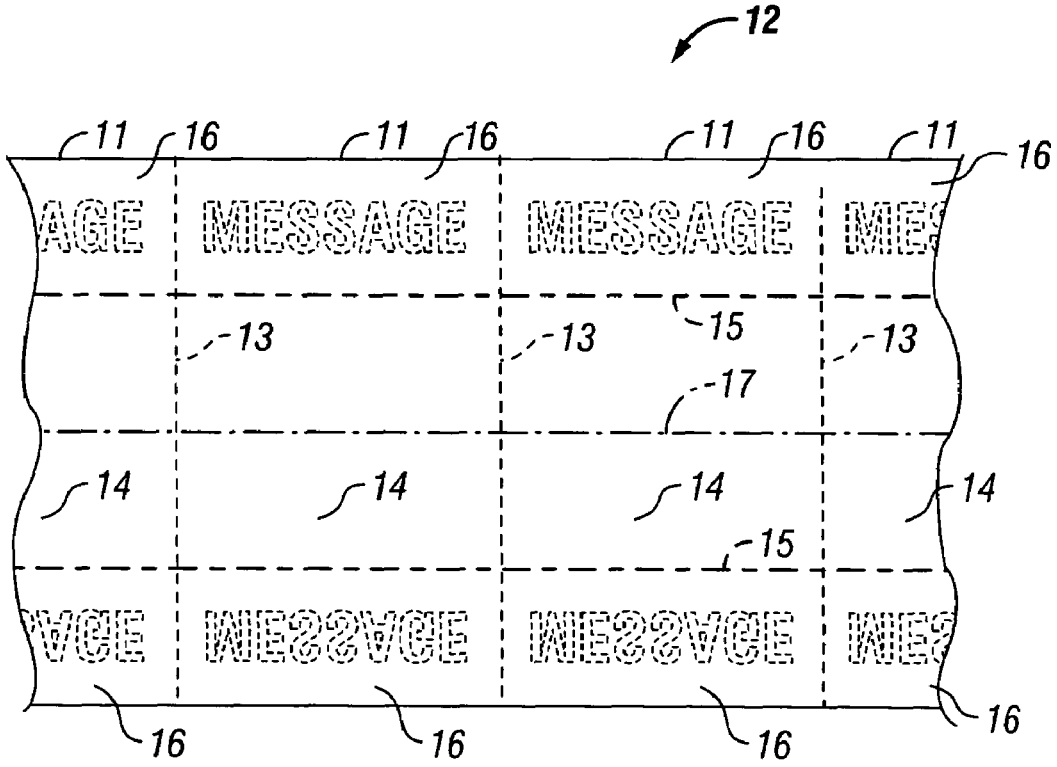
FIG. 3 is a top plan view of a web 12 from which the novel container 10 may be fabricated.

An example of this first preferred embodiment is shown in FIGS. 1-3, and may be viewed as an improvement on conventional pillow-shaped three-sided seal pouch containers. As will be appreciated from FIGS. 1-3, container 10 comprises a single sheet 11 that preferably is fabricated from a continuous web 12 providing a plurality of sheets 11 defined by seal-cut lines 13. Each sheet 11 has a pouch section 14 bounded by seal-cut lines 13 and seal lines 15. Each sheet 11 also has two message sections 16 bounded by seal-cut lines 13, seal lines 15, and the edges of web 12.

Web 12 is folded along longitudinal fold line 17 passing through pouch sections 14 such that the two halves thereof are generally overlaid. It will be understood that longitudinal is a reference to a direction running generally along the length of the web 12, while transverse references a direction generally perpendicular thereto and running across the width of the web. Thus folded, it will be appreciated that the boundaries of the pouch sections 14 overlap, i.e. seal-cut lines 13 are folded over on themselves and the top and bottom seal lines 15 are brought together. The folded web 12 is then sealed along seal-cut lines 13, or at least that portion of seal-cut lines 13 extending between seal lines 15, and product is inserted into the open pouches formed thereby. After product is inserted, web 12, i.e., the open pouches formed in web 12, is sealed along seal lines 15. The pouch sections 14 are thereby sealed along their boundaries and, as seen best in FIG. 2, define sealed volumes 18 in which product (shown schematically) is disposed. Thereafter, the folded and sealed web 12 is cut along seal-cut lines 13 to provide a plurality of individual containers 10 having a top seal (opposite the fold) and two side seals.

It will be appreciated that the container 10 thereby includes two message sections 16 extending upward from the top seal of the pouch 18. Perforations 19, as shown in FIG. 1, may be provided at or near seal lines 15 to allow the message sections to be more easily separable from the pouch 18. Alternatively, if perforations are not provided, the message sections may be torn or cut from the pouch 18 and a tear notch or imprinted cut lines may be provided for such purposes.

As a further example, and in accordance with a second preferred embodiment, the novel pouch container is fabricated from a flexible imprintable substrate sheet comprising two rectangular pouch sections and a message section extending between the pouch sections. The substrate sheet is folded in half along a line passing through the message section such that the two pouch sections overlay each other. The boundaries of the pouch section are sealed to define a generally rectangular-shaped sealed volume having a top, bottom, and side seals, the bottom seal being proximate to the fold line. The message section extends from the bottom seal of the sealed volume.

Figure 4:
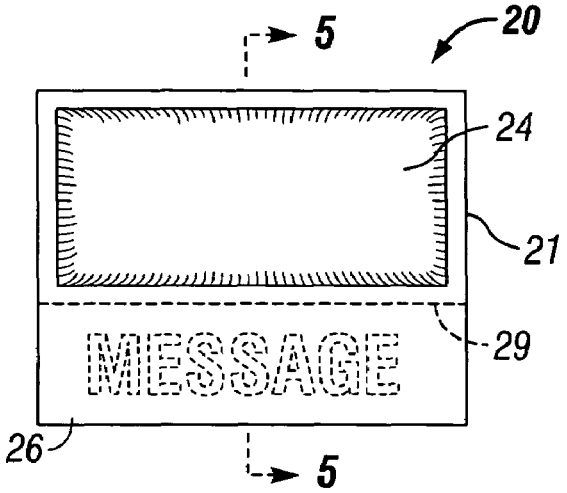
FIG. 4 is a top plan view of a second preferred embodiment 20 of the pouch containers of the subject invention, which container 20 comprises a separable imprintable message section extending from the bottom seal of a three-sided seal pouch and providing media for advertising messages.
Figure 5:
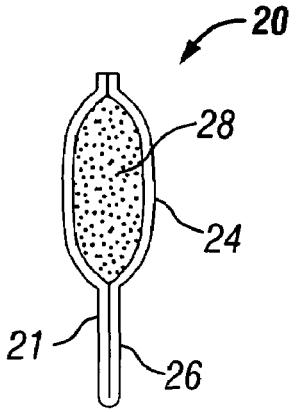
FIG. 5 is a cross-sectional view of the novel pouch container 20 shown in FIG. 4 taken along line 5-5 thereof showing the construction of container 20.
Figure 6:
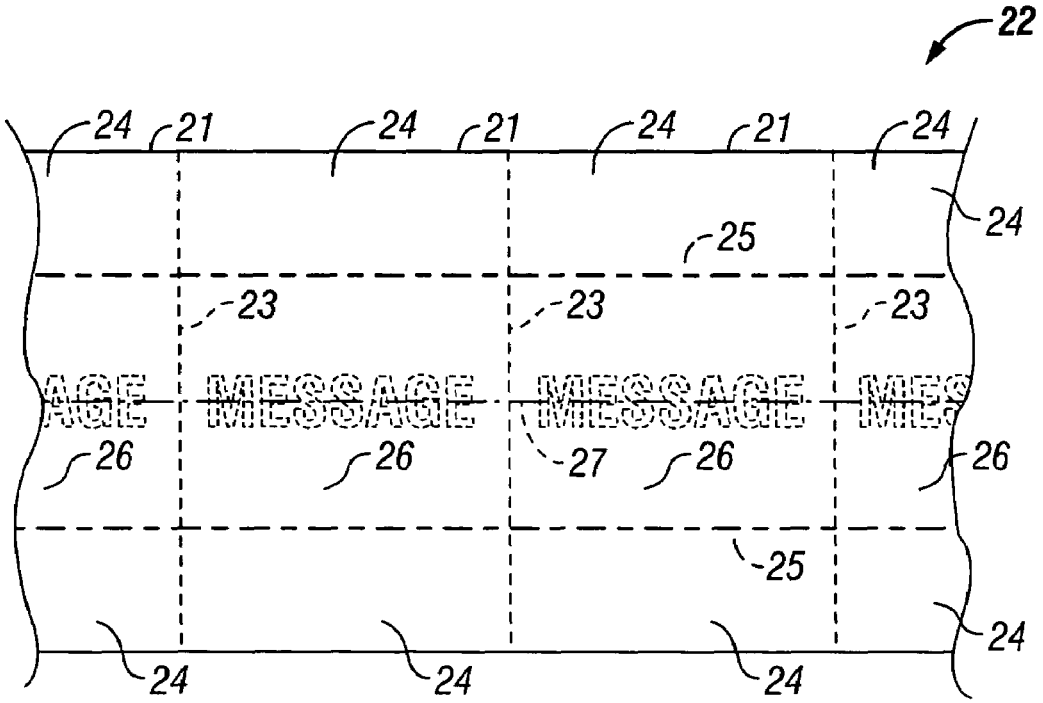
FIG. 6 is a top plan view of a web 22 from which the novel container 20 may be fabricated.

An example of this second preferred embodiment is shown in FIGS. 4-6, and it also may be viewed as an improvement on conventional pillow-shaped three-sided seal pouch containers. As will be appreciated from FIGS. 4-6, container 20 comprises a single sheet 21 that preferably is fabricated from a continuous web 22 providing a plurality of sheets 21 defined by seal-cut lines 23. Each sheet 21 has two pouch sections 24 bounded by seal-cut lines 23, seal lines 25, and the edges of web 22. Each sheet 21 also has a message section 26 bounded by seal-cut lines 23 and seal lines 25.

Web 22 is folded along fold line 27 passing through message sections 26 such that the two halves thereof are generally overlaid and the boundaries of the pouch sections 24 overlap. The folded web 22 is then sealed along seal lines 25 and along seal-cut lines 23, or at least along the length of seal-cut lines 23 extending between seal lines 25 and the edges of web 22, and product is inserted into the open pouches formed thereby. After product is inserted, web 22, i.e., the open pouches formed in web 22, is sealed along its edges. The pouch sections 24 are thereby sealed along their boundaries and, as seen best in FIG. 5, define sealed volumes 28 in which product is disposed. Thereafter, the folded and sealed web 22 is cut along seal-cut lines 23 to provide a plurality of individual containers 20 having a top seal, bottom seal (proximate to the fold), and two side seals.

It will be appreciated that the container 20 thereby includes a message section 26 extending downward from the bottom seal of pouch 28. Perforations 29, as shown in FIG. 4, may be provided at or near seal lines 25 to allow the message sections to be more easily separable from the pouch 28. Alternatively, if perforations are not provided, the message section may be torn or cut from the pouch 28 and a tear notch or imprinted cut lines may be provided for such purposes.

As another example, and in accordance with a third preferred embodiment, the novel pouch container is fabricated from a flexible imprintable substrate sheet comprising a rectangular pouch section and a message section extending from a side edge thereof. The substrate sheet is folded in half along a line passing through the pouch section and the message section to provide two rectangular, overlaid folds. The boundaries of the pouch section are sealed to define a generally rectangular-shaped sealed volume having a top and side seals, the side seals being adjacent to the fold line. The message section extends from a side seal of the sealed volume.

Figure 7:
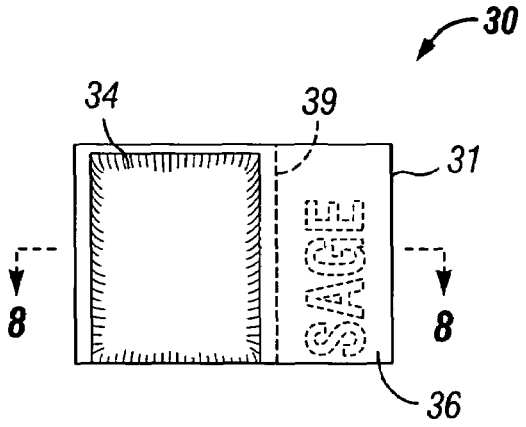
FIG. 7 is a top plan view of a third preferred embodiment 30 of the pouch containers of the subject invention, which container 30 comprises two separable imprintable message sections extending from a side seal of a three-sided seal pouch and providing media for advertising messages.
Figure 8:
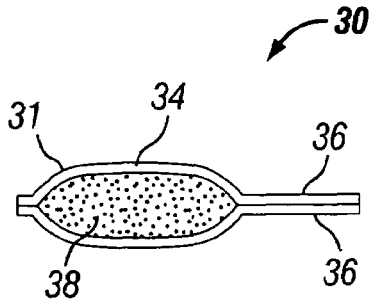
FIG. 8 is a cross-sectional view of the novel pouch container 30 shown in FIG. 7 taken along line 8-8 thereof showing the construction of container 30.
Figure 9:
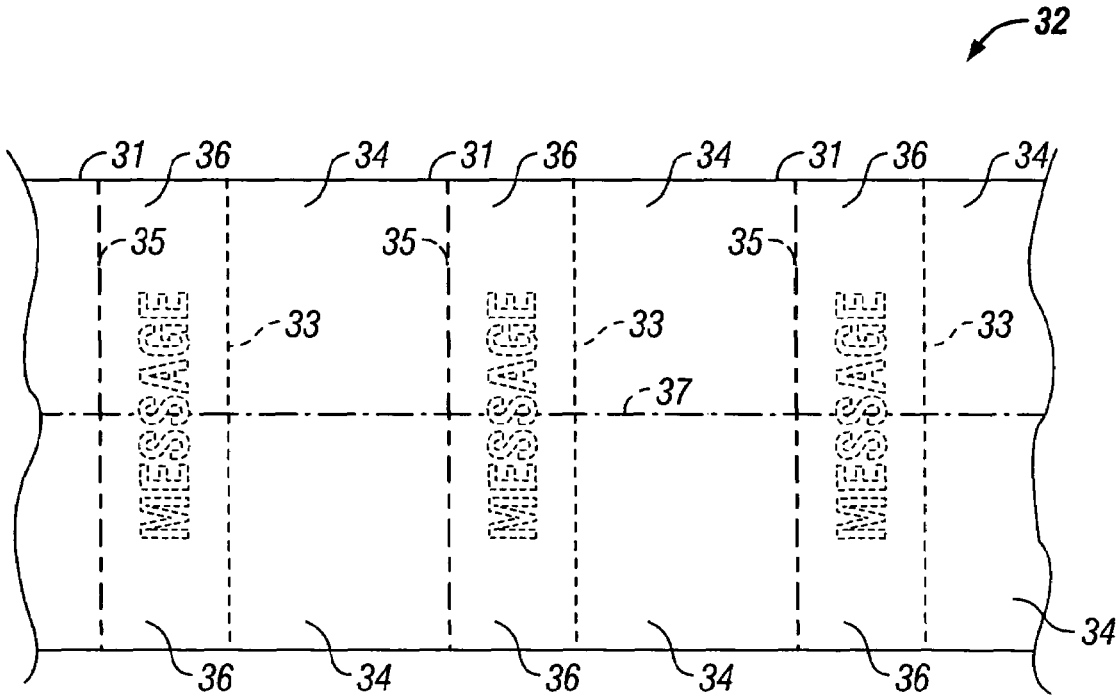
FIG. 9 is a top plan view of a web 32 from which the novel container 30 may be fabricated.

An example of this third preferred embodiment is shown in FIGS. 7-9, and like the first and second preferred embodiments described above it also may be viewed as an improvement on conventional pillow-shaped three-sided seal pouch containers. As will be appreciated from FIGS. 7-9, container 30 comprises a single sheet 31 that preferably is fabricated from a continuous web 32 providing a plurality of sheets 31 defined by seal-cut lines 33. Each sheet 31 has a pouch section 34 bounded by seal-cut lines 33, seal lines 35, and the edges of web 32. Each sheet 31 also has a message section 36 bounded by seal-cut lines 33, seal lines 35, and the edges of web 32.

Web 32 is folded along fold line 37 passing through pouch sections 34 and message sections 36 such that the two halves thereof are generally overlaid and the boundaries of the pouch sections 34 overlap. The folded web 32 is then sealed along seal-cut lines 33 and along seal lines 35 and product is inserted into the open pouches formed thereby in pouch sections 34. After product is inserted, web 32, i.e., the open pouches formed in web 32, is sealed along its edges, or at least those portions of the edges of web 32 bounding the pouch sections 34. The pouch sections 34 are thereby sealed along their boundaries and, as seen best in FIG. 8, define sealed volumes 38 in which product is disposed. Thereafter, the folded and sealed web 32 is cut along seal-cut lines 33 to provide a plurality of individual containers 30 having a top seal and two side seals (adjacent to the fold).

It will be appreciated that the container 30 thereby includes a message section 36 extending from a side seal of the pouch 38 adjacent to the fold line 37 therein. Perforations 39, as shown in FIG. 7, may be provided at or near seal lines 35 to allow the message sections to be more easily separable from the pouch 38. Alternatively, if perforations are not provided, the message section may be torn or cut from the pouch 38 and a tear notch or imprinted cut lines may be provided for such purposes.

As yet another example, and in accordance with a fourth preferred embodiment, the novel pouch container is fabricated from a flexible imprintable substrate sheet comprising a single, rectangular pouch section and a message section extending from a boundary thereof. The substrate sheet is folded along two longitudinal fold lines passing through the pouch section parallel to the boundary from which the message section extends to provide two rectangular folds overlaying a third rectangular fold. The boundaries of the pouch section are sealed to define a generally rectangular-shaped sealed volume having a seal extending across one face thereof and end seals. The message section extends from the face seal of the pouch section.

Figure 10:
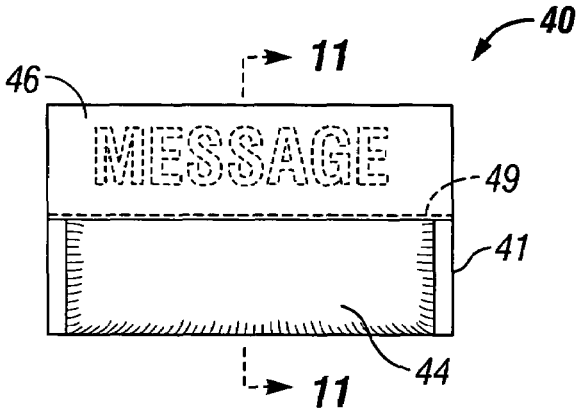
FIG. 10 is a top plan view of a fourth preferred embodiment 40 of the pouch containers of the subject invention, which container 40 comprises two separable imprintable message sections extending from a face seal of a wrap-style three-sided seal pouch and providing media for advertising messages.
Figure 11:
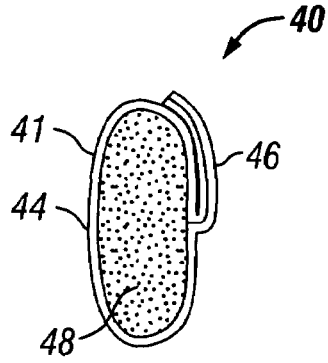
FIG. 11 is a cross-sectional view of the novel pouch container 40 shown in FIG. 10 taken along line 11-11 thereof showing the construction of container 40.
Figure 12:
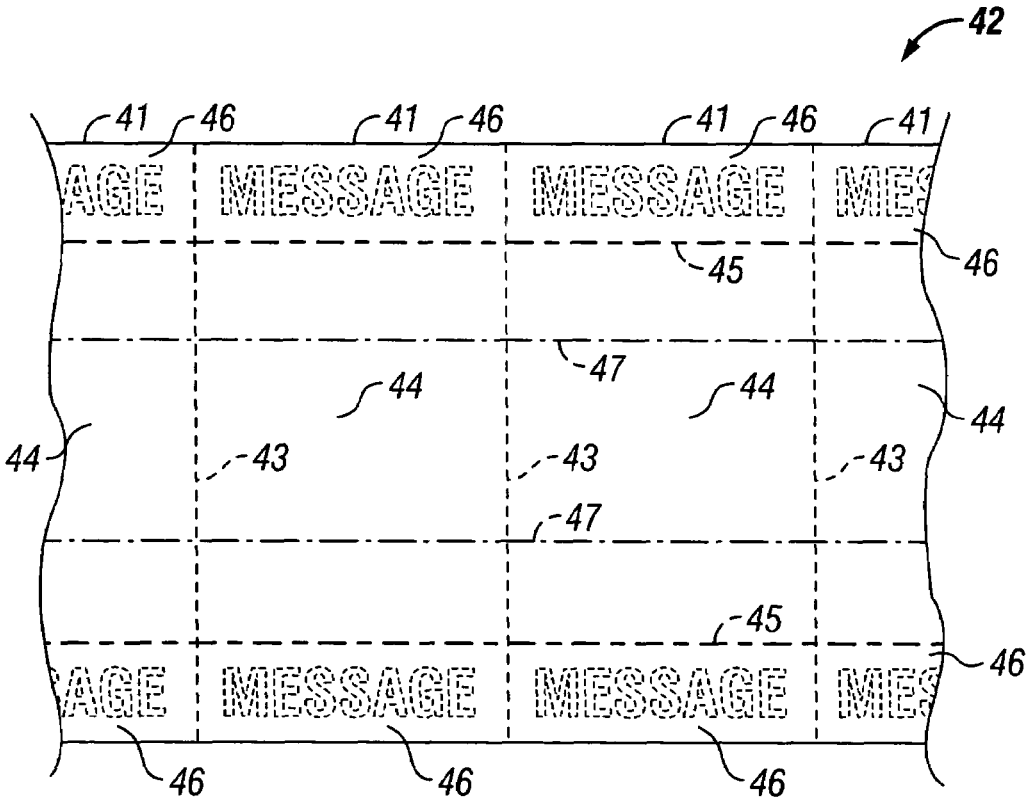
FIG. 12 is a top plan view of a web 42 from which the novel container 40 may be fabricated.

An example of this fourth preferred embodiment is shown in FIGS. 10-12, and may be viewed as an improvement on conventional pillow-shaped, wrap-style three-sided seal pouch containers. As will be appreciated from FIGS. 10-12, container 40 comprises a single sheet 41 that preferably is fabricated from a continuous web 42 providing a plurality of sheets 41 defined by seal-cut lines 43 and the edges of web 42. Each sheet 41 has a pouch section 44 bounded by seal-cut lines 43 and seal lines 45. Each sheet 41 also has two message sections 46 bounded by seal-cut lines 43, seal lines 45, and the edges of web 42.

Web 42 is folded along longitudinal fold lines 47 passing through pouch sections 44 such that the two end portions of pouch section 44 generally overlay the middle portion thereof and the boundaries of the pouch section 44 overlap. A longitudinal seal then is applied along seal lines 45, in what will become a face of the pouch, and a first transverse seal is applied along a cut-seal line 43. The cut-seal line 43 immediately upstream from the sealed cut-seal line is left unsealed. In this manner an open pouch is formed into which product is inserted. After product is inserted, the open pouch formed in web 42 is sealed by forming a second transverse seal at the upstream cut-seal line 43. The pouch section 44 is thereby sealed along its boundaries and defines, as seen best in FIG. 11, sealed volume 48 in which product is disposed. Finally, the folded and sealed web 42 is cut just below the first formed, downstream transverse seal, thereby producing an individual container 40 having a seal extending across one face of the container and two end seals. This also leaves the longitudinally sealed web 42 with an open, unsealed end. The process may be repeated to produce additional containers 40.

It will be appreciated that the container 40 thereby includes two message sections 46 extending from the face seal of pouch 48 and folded across the face thereof. As with other embodiments described above, perforations 49, as shown in FIG. 10, may be provided between the message sections 46 and pouch 48 so that the message sections 46 may be easily separated from the pouch 48. Alternatively, if perforations are not provided, the message sections may be torn or cut from the pouch 48 and a tear notch or imprinted cut lines may be provided for such purposes.

As a further example, and in accordance with a fifth preferred embodiment, the novel pouch container is fabricated from a flexible imprintable substrate sheet comprising a single, rectangular pouch section and a message section extending from a transverse side thereof. The substrate sheet is folded along two longitudinal fold lines passing through the pouch section and the message section to provide two rectangular folds overlaying a third rectangular fold. The longitudinal and transverse boundaries of the pouch section are sealed to define a generally rectangular-shaped sealed volume having a face seal and end seals. The message section extends from an end seal of the pouch section.

Figure 13:
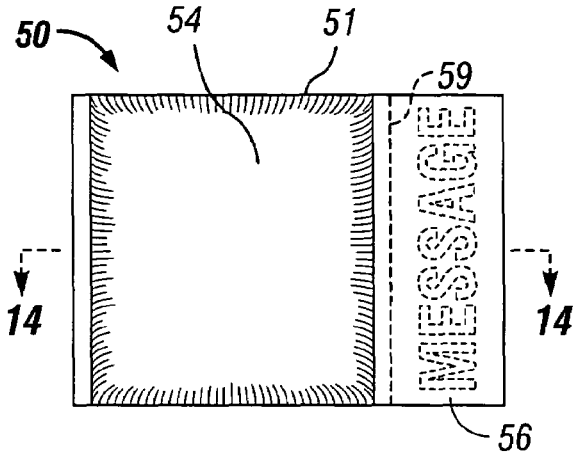
FIG. 13 is a top plan view of a fifth preferred embodiment 50 of the pouch containers of the subject invention, which container 50 comprises two separable imprintable message sections extending from an end seal of a wrap-style three-sided seal pouch and providing media for advertising messages.
Figure 14:
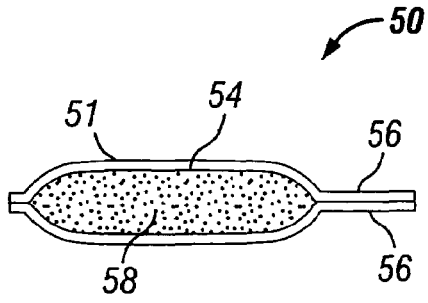
FIG. 14 is a cross-sectional view of the novel pouch container 50 shown in FIG. 13 taken along line 14-14 thereof showing the construction of container 50.
Figure 15:
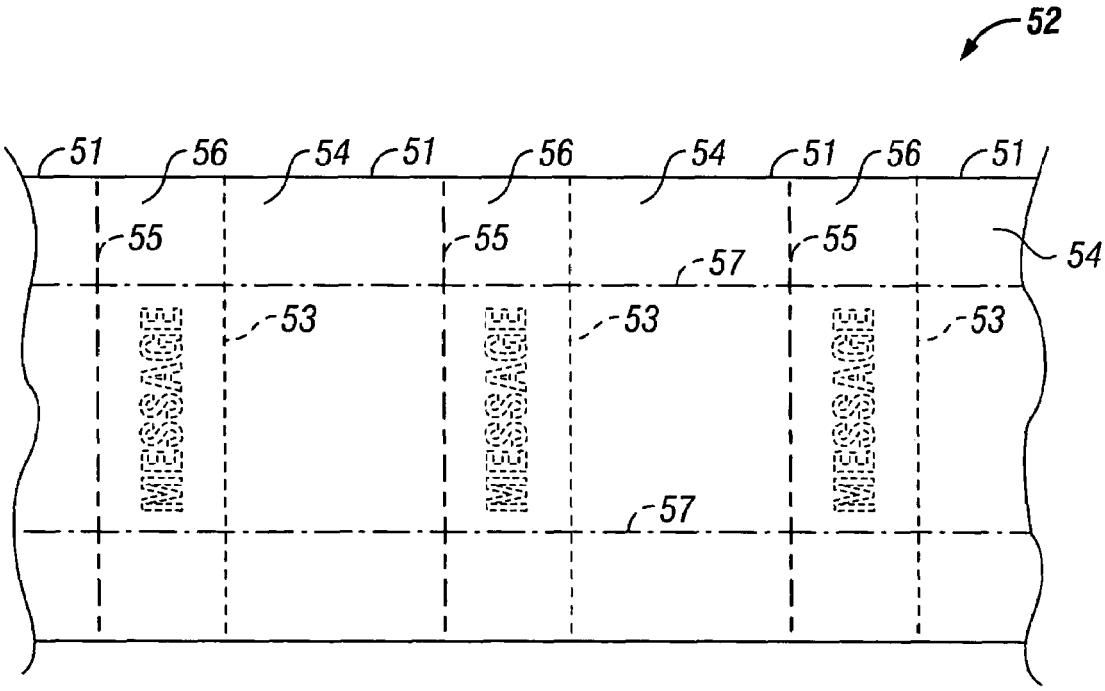
FIG. 15 is a top plan view of a web 52 from which the novel container 50 may be fabricated.

An example of this fifth preferred embodiment is shown in FIGS. 13-15, and may be viewed as an improvement on conventional pillow-shaped, wrap-style three-sided seal pouch containers. As will be appreciated from FIGS. 13-15, container 50 comprises a single sheet 51 that preferably is fabricated from a continuous web 52 providing a plurality of sheets 51 defined by seal-cut lines 53 and the edges of web 52. Each sheet 51 has a pouch section 54 bounded by seal-cut lines 53, seal lines 55, and the edges of web 52. Each sheet 51 also has a message section 56 bounded by seal-cut lines 53, seal lines 55, and the edges of web 52.

Web 52 is folded along longitudinal fold lines 57 passing through pouch sections 54 and message sections 56 such that the two end portions of pouch section 54 generally overlay the middle portion thereof and the boundaries of the pouch sections 54 overlap. A longitudinal seal then is applied along or proximate to the edges, and a first transverse seal is applied along a cut-seal line 53. The cut-seal line 53 immediately upstream from the sealed cut-seal line is left unsealed. In this manner an open pouch is formed into which product is inserted. After product is inserted, the open pouch formed in web 52 is sealed by forming a second transverse seal at the upstream seal line 55. The pouch section 54 is thereby sealed along its boundaries and defines, as seen best in FIG. 14, sealed volume 58 in which product is disposed. Finally, the folded and sealed web 52 is cut just below the first formed, downstream transverse seal, thereby producing an individual container 10 having a seal extending across one face of the container and two end seals. This also leaves the longitudinally sealed web 52 with an open, unsealed end. The process may be repeated to produce additional containers 10.

It will be appreciated that the container 50 thereby includes a message section 56 extending from an end seal of pouch 58. As with other embodiments described above, perforations 59, as shown in FIG. 13, may be provided between the message section 56 and pouch 58 so that the message section 56 may be easily separated from the pouch 58. Alternatively, if perforations are not provided, the message section may be torn or cut from the pouch 58 and a tear notch or imprinted cut lines may be provided for such purposes.

Various other preferred embodiments of the novel invention include a product packaged in a pouch container comprising two flexible imprintable substrate sheets. Each of the substrate sheets comprises a pouch section. At least one of the substrate sheets also comprises a message section adjacent to the pouch section thereon. The pouch sections of the substrate sheets are superimposed such that their boundaries overlap and are sealed to define a sealed volume accommodating the product with the message section extending from a sealed boundary of the pouch section. The message section provides a substrate on which an advertising message may be imprinted and viewed by a consumer of the product. It is separable from the pouch section and the sealed volume defined thereby without compromising the integrity of the sealed volume.

Figure 16:
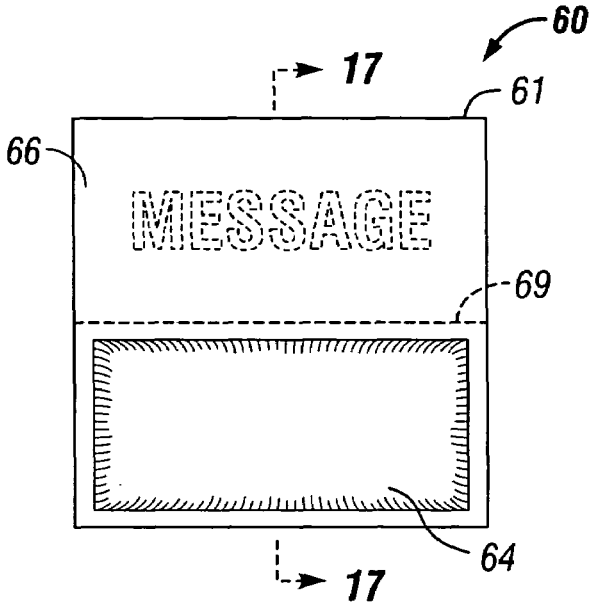
FIG. 16 is a top plan view of a sixth preferred embodiment 60 of the pouch containers of the subject invention, which container 60 comprises two separable imprintable message sections extending from a seal of a four-sided seal pouch and providing media for advertising messages.
Figure 17:
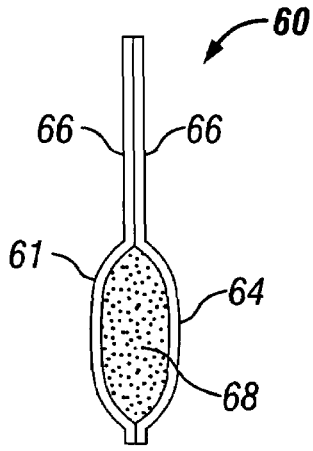
FIG. 17 is a cross-sectional view of the novel pouch container 60 shown in FIG. 16 taken along line 17-17 thereof showing the construction of container 60.
Figure 18:
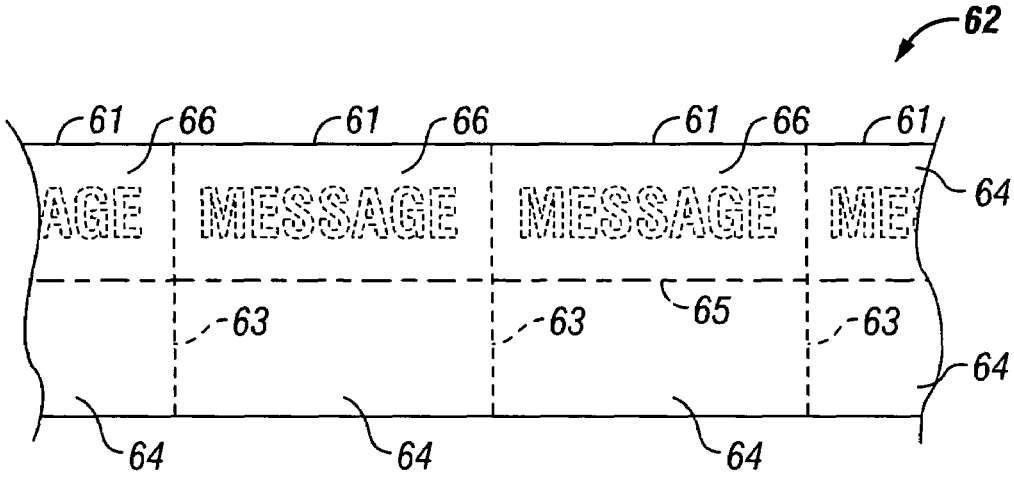
FIG. 18 is a top plan view of a web 62 from which the novel container 60 may be fabricated.
Figure 19:
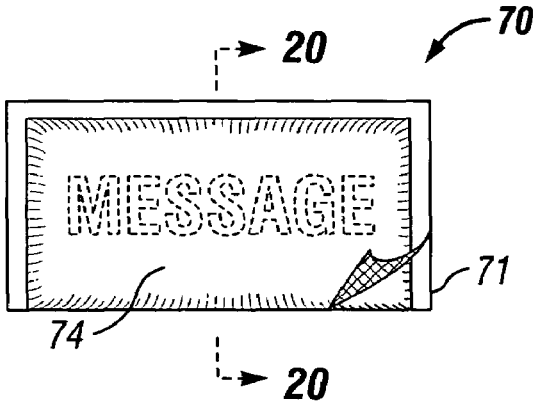
FIG. 19 is a top plan view, partially torn-away, of a seventh preferred embodiment 70 of the pouch containers of the subject invention, which container 70 comprises a separable imprintable message sheet affixed to a face side of a three-sided seal pouch and providing media for advertising messages.
Figure 20:
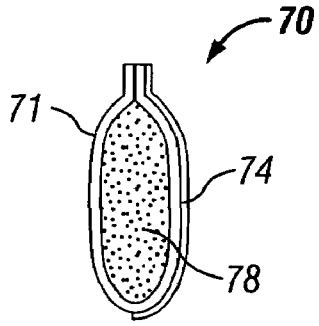
FIG. 20 is a cross-sectional view of the novel pouch container 70 shown in FIG. 19 taken along line 20-20 thereof showing the construction of container 70.
Figure 21:
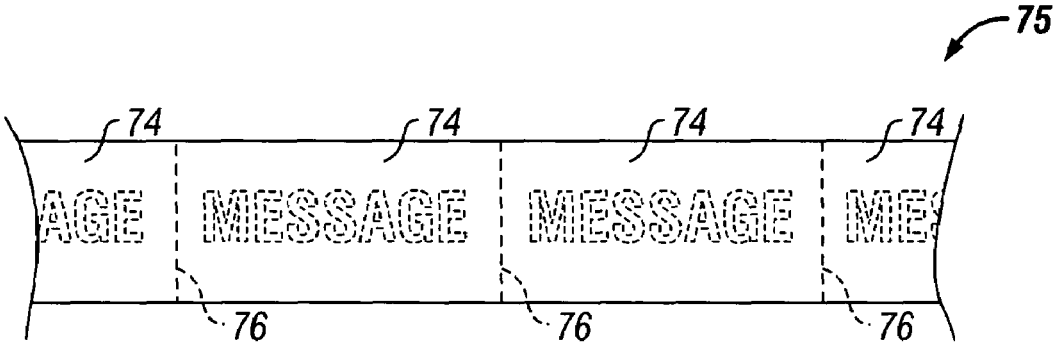
FIG. 21 is a top plan view of a web 75 from which the message sheet of novel container 70 may be fabricated.
Figure 22:
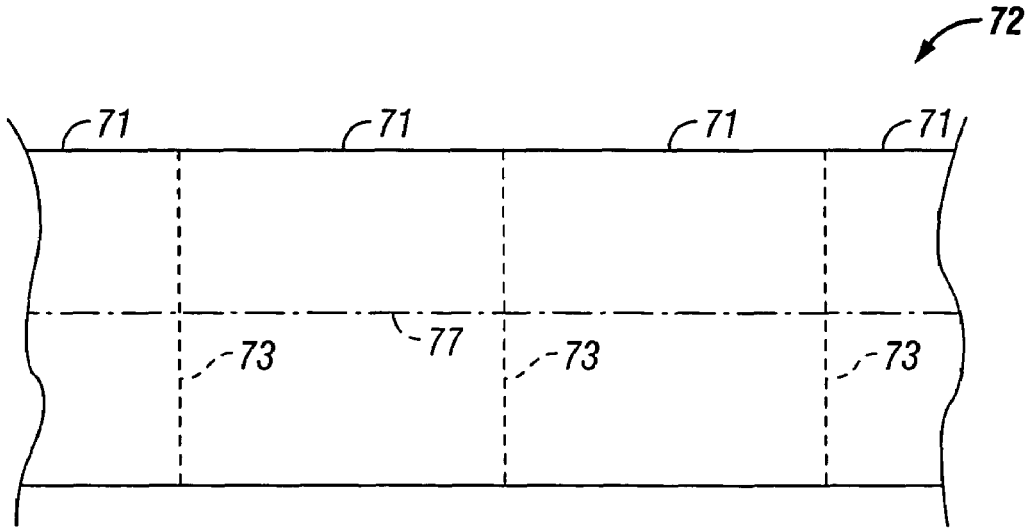
FIG. 22 is a top plan view of a web 72 from which the pouch of novel container 70 may be fabricated.
Figure 23:
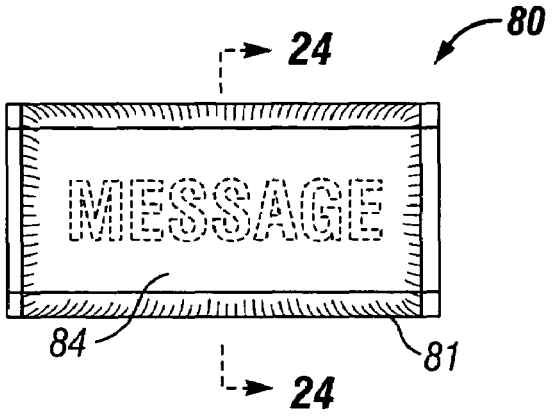
FIG. 23 is a top plan view of a eighth preferred embodiment 80 of the pouch containers of the subject invention, which container 80 comprises a separable imprintable message sheet affixed to a face side of a wrap-style, three-sided seal pouch and providing media for advertising messages.
Figure 24:
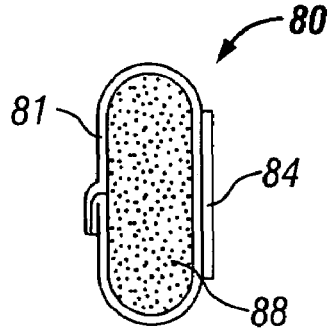
FIG. 24 is a cross-sectional view of the novel pouch container 80 shown in FIG. 23 taken along line 24-24 thereof showing the construction of container 80.
Figure 25:
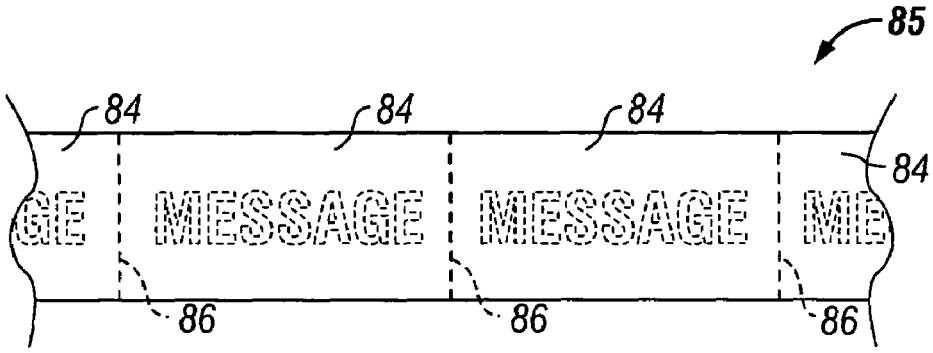
FIG. 25 is a top plan view of a web 85 from which the message sheet of novel container 80 may be fabricated.
Figure 26:
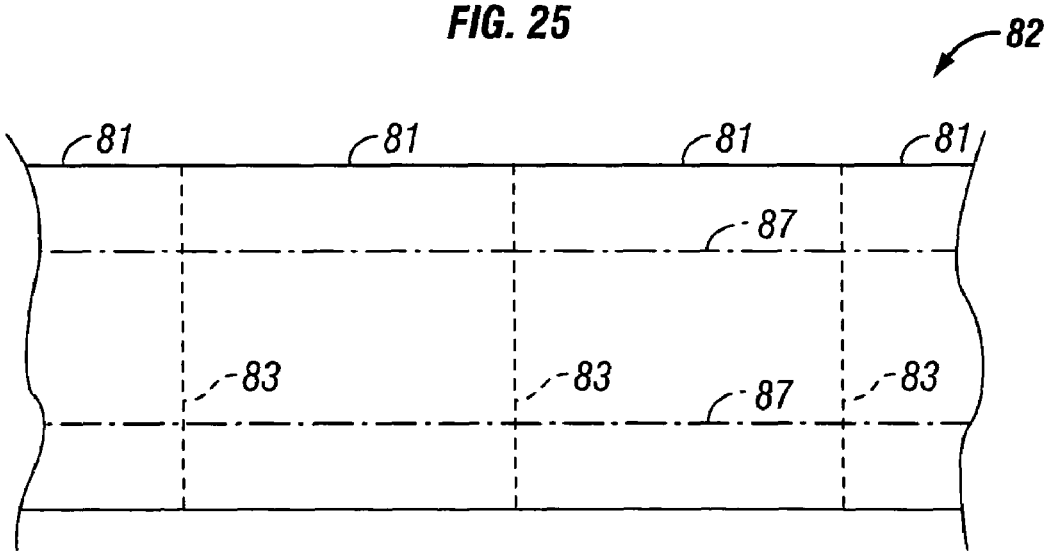
FIG. 26 is a top plan view of a web 82 from which the pouch of novel container 80 may be fabricated.

An example thereof, and a sixth preferred embodiment of the subject invention is shown in FIGS. 16-18. It may be viewed as an improvement on conventional pillow-shaped four-sided seal pouch containers. As will be appreciated from FIGS. 16-18, container 60 comprises two sheets 61 that preferably are fabricated from a continuous web 62 providing a plurality of sheets 61 defined by seal-cut lines 63. Each sheet 61 has a pouch section 64 bounded by seal-cut lines 63, seal line 65, and an edge of the web 62. Each sheet 61 also has a message section 66 bounded by seal-cut lines 63, seal line 65, and the other edge of web 62.

A pair of webs 62 are superimposed such that the boundaries of the pouch sections 64 thereon overlap. The webs 62 are then sealed along seal-cut lines 63 and seal line 65 and product is inserted into the open pouches formed thereby. After product is inserted, webs 62, i.e., the open pouches formed in webs 62, are sealed along the edge of the webs 62. The pouch sections 64 are thereby sealed along their boundaries and, as seen best in FIG. 17, define sealed volumes 68 in which product is disposed. Thereafter, the sealed webs 62 are cut along seal-cut lines 63 to provide a plurality of individual containers 60 having four side seals.

It will be appreciated that the container 60 thereby includes two message sections 66 extending from a seal in pouch 68. Perforations 69, as shown in FIG. 16, may be provided at or near seal lines 65 to allow the message sections to be more easily separable from the pouch 68. Alternatively, if perforations are not provided, the message sections may be torn or cut from the pouch 68 and a tear notch or imprinted cut lines may be provided for such purposes.

While containers 10, 20, 30, 40, 50, and 60, each comprise two message sections extending from a seal therein, it will be appreciated that similar containers may be fabricated that have only one such message section. Moreover, while the description above generally contemplates that the message sections in those containers are connected to their respective seals, if desired, the message sections also may be affixed to each other, e.g., by applying a seal or adhesive during the process of forming, filling, and sealing the containers.

Various other preferred embodiments of the novel invention include a product packaged in a pouch container comprising one or two pouch sheets. The pouch sheets are composed of a flexible imprintable substrate and define a sealed volume accommodating the product. The container also comprises a message sheet composed of an imprintable substrate. The message sheet is affixed to at least one of the pouch sheets on an exterior surface thereof. It provides a substrate on which an advertising message may be imprinted and viewed by a consumer of the product. The message sheet is separable from the pouch sheets and the sealed volume defined thereby without compromising the integrity of the sealed volume.

For example, and in accordance with a seventh preferred embodiment, the novel pouch container is fabricated from a single pouch sheet. The pouch sheet is folded such that portions thereof overlay each other and the overlaid portions are sealed at the boundaries thereof to define a sealed volume accommodating the product therein and having front and back exterior faces. A message sheet is affixed to a face of the sealed volume.

As example of this seventh preferred embodiment is shown in FIGS. 19-22, and may be viewed as an improvement on conventional pillow-shaped three-sided seal pouch containers. As will be appreciated from FIGS. 19, 20 and 22, container 70 comprises a pouch sheet 71 that preferably is fabricated from a continuous web 72 providing a plurality of pouch sheets 71 defined by seal-cut lines 73. Container 70 also comprises a message sheet 74 that preferably is fabricated from a continuous web 75 providing a plurality of message sheets 74 defined by cut lines 76 shown in FIG. 21.

Pouch web 72 is folded along longitudinal fold line 77 passing through pouch sheets 71 such that the two halves thereof are generally overlaid and the boundaries of the pouch sheets 71 overlap. The folded web 72 is then sealed along seal-cut lines 73, and message web 75 is affixed thereto with cut-lines 76 in register with cut-seal lines 73. Product is inserted into the open pouches formed thereby. After product is inserted, pouch web 72, i.e., the open pouches formed in web 72, is sealed along the edges thereof. The pouch sections 71 are thereby sealed along their boundaries and, as seen best in FIG. 20, define sealed volumes 78 in which product is disposed. Thereafter, the folded pouch web 72 with the message web 75 affixed thereto is cut along seal-cut lines 73 and cut lines 76 to provide a plurality of individual containers 70 having a top seal and two side seals.

It will be appreciated that the container 70 thereby includes a message sheet 74 affixed to one of the faces of pouch 78. A tab may be provided on message sheets 74 to facilitate the separation thereof from the pouch 78. Also, it is not necessary that the message sheet 74 be affixed to the pouch 78 continuously across their abutting surfaces, and it may be preferable to leave a portion of the message sheet unbonded to enable the message sheet to be more easily peeled off and removed.

As a further example, and in accordance with an eighth preferred embodiment, the novel pouch container is fabricated from one pouch sheet. The pouch sheet is folded along two longitudinal fold lines such that the boundaries thereof overlay each other. The overlaid portions of the boundaries are sealed to define a sealed volume accommodating the product therein and having front and back exterior faces. A message sheet is affixed to a face of the sealed volume.

An example of this eighth preferred embodiment is shown in FIGS. 23-26, and may be viewed as an improvement on conventional pillow-shaped three-sided seal "wrap" pouch containers. As will be appreciated from FIGS. 23, 24 and 26, container 80 comprises a pouch sheet 81 that preferably is fabricated from a continuous web 82 providing a plurality of pouch sheets 81 defined by seal-cut lines 83. Container 80 also comprises a message sheet 84 that preferably is fabricated from a continuous web 85 providing a plurality of message sheets 84 defined by cut lines 86 shown in FIG. 25.

Pouch web 82 is folded along longitudinal fold lines 87 passing through pouch sheets 81 such that the two end portions of the pouch sheets 81 generally overlay the middle portion thereof and the boundaries of the pouch sheets 81 overlap. A longitudinal seal then is applied along or proximate to the edges, and message web 85 is affixed to pouch web 82 with cut-lines 86 in register with cut-seal lines 83. A first transverse seal is applied along a cut-seal line 83, and the cut-seal line 83 immediately upstream from the sealed cut-seal line is left unsealed. In this manner an open pouch is formed into which product is inserted. After product is inserted, the open pouch formed in web 82 is sealed by forming a second transverse seal at the upstream seal-cut line 83. The pouch sheet 81 84 is thereby sealed along its boundaries and defines, as seen best in FIG. 24, sealed volume 88 in which product is disposed. Finally, the folded and sealed web 82 with message web 85 affixed thereto is cut just below the first formed, downstream transverse seal, thereby producing an individual container 80 having a seal extending across one face of the container and two end seals. This also leaves the longitudinally sealed web 82 with an open, unsealed end. The process may be repeated to produce additional containers 80.

It will be appreciated that the container 80 thereby includes a message sheet 84 affixed to one face of the pouch 88. A tab may be provided on message sheets 84 to facilitate the separation thereof from the pouch 88. Also, it is not necessary that the message sheet 84 be affixed to the pouch 88 continuously across their abutting surfaces, and it may be preferable to leave a portion of the message sheet unbonded to enable the message sheet to be more easily peeled off and removed.

While containers 70 and 80 comprise, respectively, a single message sheet 74 and 84, it will be appreciated that the subject invention encompasses containers having message sheets on both faces of a pouch container. Moreover, multiple message sheets may be provided on a single face by, e.g., by laminating or otherwise affixing multiple message sheets together and affixing one of the sheets to the face of the container.

Various other preferred embodiments of the novel invention include a product packaged in a pouch container comprising one or two pouch sheets. The pouch sheets are composed of a flexible imprintable substrate and define a sealed volume accommodating the product. At least one of the pouch sheets is comprised by a laminate sheet comprising the pouch sheet and a message sheet. The message sheet is composed of an imprintable substrate, and it provides a substrate on which an advertising message may be imprinted and viewed by a consumer of the product. The message sheet is separable from the laminate sheet and the sealed volume defined thereby without compromising the integrity of the sealed volume.

For example, and in accordance with a ninth preferred embodiment, the novel pouch container is fabricated from a laminate sheet comprising a pouch sheet and a message sheet. The laminate sheet is folded such that the boundaries of the pouch sheet overlap and are sealed to define a sealed volume accommodating the product. The message sheet is exterior to the pouch sheet and, therefore, may be removed from the pouch without compromising the integrity of the sealed volume.

Figure 27:
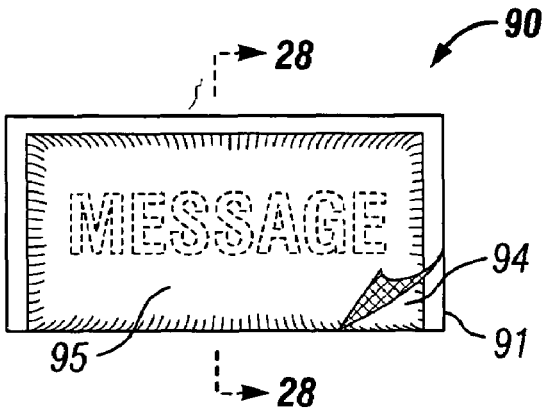
FIG. 27 is a top plan view, partially torn-away, of a ninth preferred embodiment 90 of the pouch containers of the subject invention, which container 90 comprises a separable imprintable message sheet laminated to the face sides of a three-sided seal pouch and providing media for advertising messages.
Figure 28:
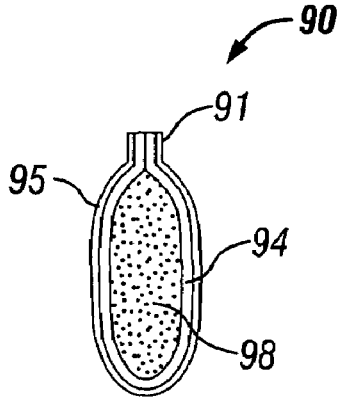
FIG. 28 is a cross-sectional view of the novel pouch container 90 shown in FIG. 27 taken along line 28-28 thereof showing the construction of container 90.
Figure 29:
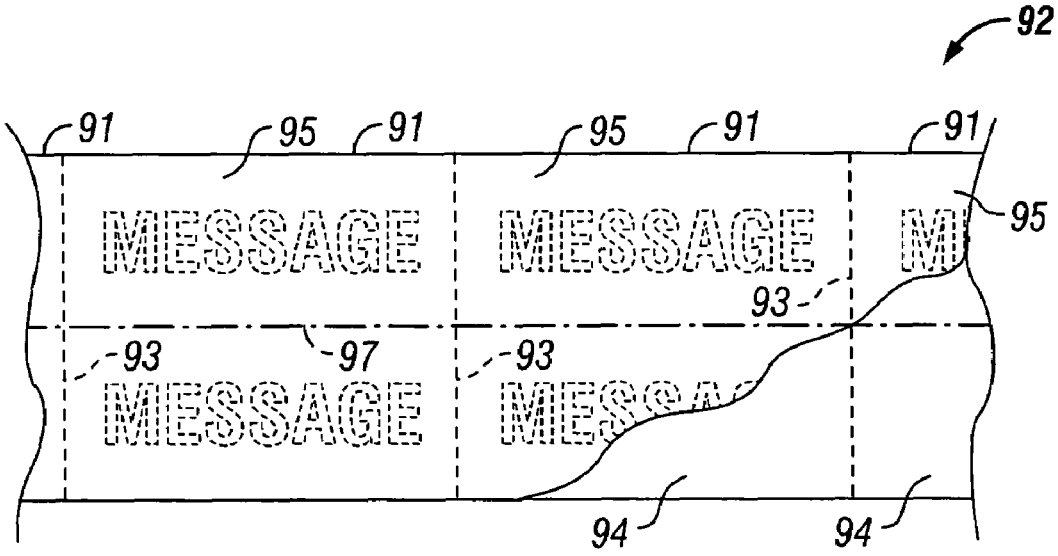
FIG. 29 is a top plan view, partially torn-away, of a web 92 from which the pouch of novel container 90 may be fabricated.

An example of this ninth preferred embodiment is shown in FIGS. 27-29, and may be viewed as an improvement on conventional pillow-shaped three-sided seal pouch containers. As will be appreciated from FIGS. 27-29, container 90 comprises a laminate sheet 91 that preferably is fabricated from a continuous web 92 providing a plurality of laminate sheets 91 defined by seal-cut lines 93. Each laminate sheet 91 comprises a pouch sheet 94 and a message sheet 95.

Laminate web 92 is folded along longitudinal fold line 97 passing through laminate sheets 91 such that the two halves thereof are generally overlaid and the boundaries of the pouch sheets 94 overlap. The folded laminate web 92 is then sealed along seal-cut lines 93, and product is inserted into the open pouches formed thereby. After product is inserted, laminate web 92, i.e., the open pouches formed in laminate web 92, is sealed along the edges thereof. The pouch sheets 94 in laminate sheet 91 are thereby sealed along their boundaries and, as seen best in FIG. 28, define sealed volumes 98 in which product is disposed. Thereafter, the folded laminate web 92 is cut along seal-cut lines 93 to provide a plurality of individual containers 90 having a top seal and two side seals.

It will be appreciated that the container 90 thereby includes a message sheet 95 affixed to the exterior surface of the pouch 98. A tab may be provided on message sheets 95 to facilitate the separation thereof from the laminate sheet 91. Alternatively, it may be preferable to leave a portion of the message sheet unbonded to the laminate sheet 91 so that the message sheet 95 may be peeled off more easily.

For example, and in accordance with a tenth preferred embodiment, the novel pouch container is fabricated from two pouch sheets, at least one of which is comprised by a laminate sheet comprising the pouch sheet and a message sheet. The pouch sheets are superimposed such that the boundaries of the pouch sheets overlap and are sealed to define a sealed volume accommodating the product. The message sheet is exterior to the pouch sheet and, therefore, may be removed from the pouch without compromising the integrity of the sealed volume.

Figure 30:
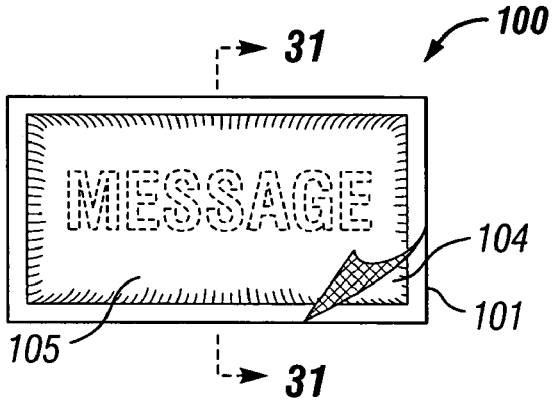
FIG. 30 is a top plan view, partially torn-away, of a tenth preferred embodiment 100 of the pouch containers of the subject invention, which container 100 comprises a separable imprintable message sheet laminated to each face side of a four-sided seal pouch and providing media for advertising messages.
Figure 31:
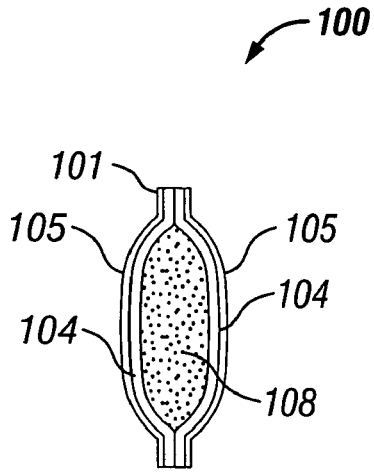
FIG. 31 is a cross-sectional view of the novel pouch container 100 shown in FIG. 30 taken along line 31-31 thereof showing the construction of container 100.
Figure 32:
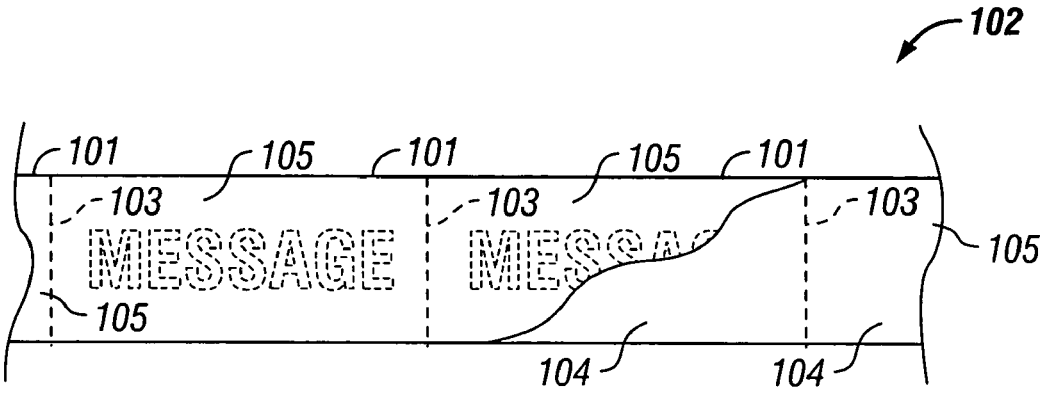
FIG. 32 is a top plan view, partially torn-away, of a web 102 from which the pouch of novel container 100 may be fabricated.

An example of this tenth preferred embodiment is shown in FIGS. 30-32, and may be viewed as an improvement on conventional pillow-shaped four-sided seal pouch containers. As will be appreciated from FIGS. 30-32, container 100 comprises two laminate sheets 101 that preferably are fabricated from continuous webs 102 providing a plurality of laminate sheets 101 defined by seal-cut lines 103. Each laminate sheet 101 comprises a pouch sheet 104 and a message sheet 105.

A pair of laminate webs 102 are superimposed such that the boundaries of the pouch sheets 104 thereon overlap. The laminate webs 102 that are sealed along seal-cut lines 103 and one edge thereof, and product is inserted into the open pouches formed thereby. After product is inserted, laminate webs 102, i.e., the open pouches formed in laminate webs 102, are sealed along the other edges thereof. The pouch sheets 104 in laminate sheets 101 are thereby sealed along their boundaries and, as seen best in FIG. 31, define sealed volumes 108 in which product is disposed. Thereafter, the sealed laminate webs 102 are cut along seal-cut lines 103 to provide a plurality of individual containers 100 having four side seals.

It will be appreciated that the container 100 thereby includes a message sheet 105 affixed to both exterior surfaces of the pouch 108. A tab may be provided on message sheets 105 to facilitate the separation thereof from the laminate sheets 101. Alternatively, it may be preferable to leave a portion of the message sheets unbonded to the laminate sheets 101 so that the message sheets 105 may be peeled off more easily.

Container 100 is fabricated from two laminate sheets, but it is not necessary to do so. Novel containers may be fabricated from a pouch sheet and a single laminate sheet, thereby providing a message sheet on only one face of a container. Also, while containers 90 and 100 comprise, respectively, laminate sheets 91 and 101 having a single message sheet 95 and 105, it will be appreciated that the subject invention encompasses containers comprising laminate sheets with more than one message sheet. Thus, multiple message sheets may be provided on one or both faces of a container. In addition, as will become apparent from the discussion that follows, the pouch sheet and message sheet in a laminate sheet used in the novel containers may themselves be a laminated substrate.

In general, the novel containers may be used to package the same types of products that are packaged in conventional pouch containers. Such products include, but are not limited to food products, such as sugar, sugar substitutes, salt, salt substitutes, pepper and other seasonings, candy, coffee, tea, drink mixes, freeze pops, ketchup, mayonnaise, mustard, sauces, salad dressing, relish, vinegar, lemon juice, honey, jellies and jams, crackers, breadsticks, croutons, bacon bits and other condiments, chemical products, such as fertilizers, adhesives, fillers, and household cleaning and laundry products, pharmaceuticals, such as vitamins, nutritional supplements, and medicines, cosmetics and health care products, such as creams, ointments, and lotions, towelettes, and dentifrices, medical products, such as catheters, sutures, syringes, swab sticks, lancets, and surgical gloves, and small parts. Such products may be in, but are not limited to the form of solids, powders, granules, tablets, liquids, semi-viscous liquids, pastes, gels, and gases.

While the novel pouch containers may be used to package a wide variety of products, they are particularly suitable for packaging single-serve products, and especially single-serve food products. Many single-serve food products are distributed in large part to consumers in food service establishments. In such settings consumers often have more time available for viewing advertisements. It is expected, therefore, that advertising messages carried on the novel containers would be more effective when the product is a single-serve food product or other product that is consumed or used under circumstances affording consumers with significant time to examine the package.

In general, the novel pouches for particular products preferably are made of materials and processes that would be used in packaging the product in conventional pouch packages. Importantly, depending on the product and the manner in which it is consumed, the materials also may be required to meet certain regulatory standards relating to health and safety, such as laws and regulations implemented and enforced by the United States Food and Drug Administration, Consumer Product Safety Commission, and other governmental and industry organizations. It will be appreciated that the novel containers, since they may be fabricated from standard and approved materials, provide a medium for advertising without diminishing the safety of the packaging.

More specifically, the substrate sheets used in the construction of the novel containers in general may be composed of any of a wide variety of imprintable substrates conventionally used in pouch packaging. Such substrates include paper, such as bond and machine glazed, cellophane, and other synthetic or natural nonwoven fibrous substrates, monolayer and coextruded films, such as those composed of high and low density polyethylene, polypropylene, ethylene vinyl alcohol, polyester, nylon, and other polymers, and aluminum and other metallic alloys, and paper-film and other laminate substrates. Suitable films will enable the imprinting of an advertising message. They also should have tear, tensile, stiffness, memory, and other physical characteristics that render them suitable for use in automated printing and packaging equipment. For many solid and powdered products, bond, book, and other types of paper based stock are preferred as they are relatively inexpensive, suitable for use in food products, may be handled relatively easily by automated equipment, and provide an excellent substrate for conventional printing processes. Machine glazed paper is especially preferred as it will provide improved print quality. Films and film laminate substrates are preferred for the same reasons when the product to be packaged is a liquid or viscous composition. Importantly, if the packaged product is a food product or other product intended for consumption, and the substrate will come in sufficiently close contact therewith, the substrate must be suitable for use in food products, and most preferably is approved by the U.S. Food and Drug Administration for such use.

In general, the choice of material for the substrate sheets will be determined by those and other factors well known to those skilled in the art of packaging, and many suitable substrates are commercially available. Typically, the substrate sheets used in the novel containers for a particular product will be the same types of substrate sheets used to package that product in conventional pouch packages. The sheets used to construct the novel containers also may be made from the same substrate or different substrates.

The sheets used to fabricate the novel containers are preferably coated or spotted in appropriate locations with a heat sealable adhesive, such as those composed of polyethylene and other thermoplastic polymers. Alternately, many films suitable for use as substrates, such as low density polyethylene (LDPE), are heat sealable. Pressure sensitive adhesives also are an alternative. In general, any suitable method of forming the necessary seals may be used. As with the other materials, however, if the containers are for food products, the adhesive or other method of sealing the sheets preferably is suitable for use in association with food products as approved by the U.S. Food and Drug Administration. Typically, the materials and methods for sealing the substrate sheets in novel containers for a particular product will be the same materials and methods used to package that product in conventional pouch packages.

The advertising message may be imprinted by any of a number of conventional printing processes well known to workers in the art. It will be further appreciated, that in the context of the subject invention, imprinting will be understood not only to include such printing processes, but also impressing, watermarking, bonding, fusing, embossing, burning, stenciling and other processes by which indicia may be imparted to the substrate to communicate the desired advertising message that are suitable for use in association with food products. The precise method of imprinting will be coordinated with the choice of substrate, and vice versa. Printing the advertising message, however, is preferred for cost reasons and because it allows great flexibility in presenting the advertising message. Soy based inks and other inks approved by the U.S. Food and Drug Administration for use in association with food products may be preferable or, under some circumstances, required by law. Preferably the advertising messages are preprinted on a suitable web prior to packaging. However, exterior or "show" sides of the packaging may be printed using noncontact methods, such as ink jet.

The advertising message, of course, will be determined by the advertiser. It will be appreciated, however, that when the message includes a manufacturer coupon redeemable by a consumer, it will be advisable to select substrates and imprinting methods that provide relatively high quality printing. That will improve machine readability of the bar code that as a practical matter must be associated with a manufacturer coupon.

It also will be appreciated that while described as pouch sections or sheets, the pouch portion of the novel container typically will also have an imprinted message on at least its exterior surface. In many instances, such messages will provide identification and information on the product that is contained in the package. Such product information will most commonly be imprinted on the pouch portion of containers such as containers 10, 20, and 30, where message sections do not cover the pouch. In other embodiments, such as containers 90 and 100, message sheets may have product information imprinted on the exterior faces thereof, and advertising messages imprinted on the interior faces and on the exterior faces of the pouch sheets. Moreover, although the novel containers are particularly useful in disseminating advertising messages other than those pertaining to the packaged product, all messages imprinted thereon may pertain to the packaged product.

The novel containers all provide imprintable media which are connected to a pouch enclosing a product, but are separable therefrom without opening the pouch. In certain embodiments, such as container 10, the imprintable message section extends from a seal and is integral with the sheet from which the container is made. It is removed by tearing or cutting. In other embodiments, such as containers 70 and 90, the message sheet is affixed to the pouch and is pealed therefrom. It may be affixed, e.g., by suitable releasable adhesives well known to workers in the art, such as low tack, peelable adhesives. As with the other materials, however, if the containers are for food products, the adhesive preferably is suitable for use in association with food products and such as those adhesives approved by the U.S. Food and Drug Administration. Any suitable methods for removeably connecting films, however, may be used.

Also, while the message sheet in container 90, for example, is affixed to the pouch sheet by lamination, i.e., by applying a substantially continuous layer of adhesive extending across the entire opposing faces thereof, it is not necessary, and may not even be desirable to do so. The adhesive may be applied discontinuously, e.g., in spots or lines. For example, the substantial portion of laminate sheet may be laminated together, but areas near the edges of the sheets may be left free of adhesive to facilitate separation of message sheets by a consumer. Also, message sheets may be affixed to a pouch at only one end thereof, so as to make it readily apparent to the consumer that it may be removed.

It also will be appreciated that while all of the novel containers specifically described comprise a single pouch, joined twin and triple packs having, respectively, two and three pouches attached together are known, as are packs with more pouches. Accordingly, the subject invention is not limited to containers having a single pouch. Multiple pouch containers having advertising media as described herein are also within the scope of the invention as set forth in the appended claims.

Also, while the illustrated embodiments all have a generally rectangular or "pillow" shape, the subject invention is not limited thereto. Pillow shaped pouches are preferred for many products because they efficiently utilize material and may be made relatively easily. The subject invention, however, is not limited to pillow shaped pouch containers. Pouches having other shapes are known or may be devised and may be used in accordance with the subject invention. Other shapes include, but are not limited to, gusset bottom and stand-up pouch containers. Other pouch containers, such as those used to package liquids and other viscous products, often have a nipple for easier dispensing of the product. In general, the shape of the pouch portion of the novel containers preferably will approximate the shape of conventional pouch containers used to package a particular product.

Likewise, the novel containers are not limited to any particular size, but the pouch portion of the novel containers also preferably will approximate the size and dimensions of conventional pouch containers used to package the same product. It will be appreciated, however, that the novel containers have particular utility when a relatively small pouch is desired, as such pouch containers heretofore have been extremely limited in providing adequate space for advertising messages.

In particular, the novel containers are particularly suitable for packaging single-serve products, and especially single-serve food products. Single-serve products are generally understood to include products that are packaged in quantities suitable for immediate use or consumption. Thus, packaging for single-serve products typically are not resealable, as such products typically are opened, the entire quantity consumed or used, and the packaging discarded. Accordingly, the amount of product in single-serve products, and the packaging for single-serve products is relatively small. The novel pouch containers, because they provide significantly greater imprintable area, may be quite small, yet still serve a medium for distributing advertising messages.

As with the pouch section, the message section of the novel containers is not limited to a particular size. Moreover, it will be appreciated that the novel pouch containers have significantly greater imprintable area, yet they do not occupy significantly more space. Those containers having a message section affixed to a face of the pouch section are not significantly thicker than the filled pouch alone. The dimensions of the message area preferably will approximate the dimensions of a pouch face, such as shown in container 70, or both pouch faces, such as shown in containers 90 and 100, so that the message area may be maximized. Where it is desired to leave a portion of the carrying face of the pouch section exposed, for example as shown in container 80, it still may be desirable to have the longitudinal dimension of the message section the same as that of the pouch section so that fabrication of the package is facilitated.

For containers such as containers 10, 20, 30, 40, 50, and 60, the message sections may be folded one or more times over onto the face of the package, thus rendering the container just slightly thicker than, but with essentially the same dimensions as a pouch container that does not have a message section. Preferably, the size of the message area will be sized to maximize the imprintable area for a given number of folds that are formed between the message section and the pouch section. The message section in a container such as container 10, for example, preferably has the same approximate dimensions as the dimensions of the face of the container so that it may be folded neatly over the face, yet provide the maximum imprintable area without having the message section extend beyond the edges of the pouch or without requiring an additional fold in the message section. If an extra fold is provided therein, such that the message area is folded twice over the same face or around both faces, the message area preferably will have twice the area of the pouch face and sized such that it neatly covers the face or faces thereof. Similarly, the area of the message section in containers such as container 40, will be sized such that it covers one half the face of the pouch section or otherwise such that the ends thereof coincide with an edge of the pouch section. This provides a neater package while maximizing the imprintable area on the message section. The folded message section, if desired, may be lightly tacked or otherwise affixed to a face of the pouch section to hold it in place.

This is a significant advantage as many single-serve products, especially those distributed through food service establishments, are dispensed in holders designed to accommodate certain, more or less standardized package sizes. The novel containers may be sized according to such conventions, yet still provide significantly larger areas for imprinting messages.

This advantage is even greater as the size of the container is diminished. Many single-serve products may be distributed under circumstances affording a consumer a relatively greater opportunity to view advertising messages. Again, single-serve products distributed through food service establishments provide a good example, as consumers often have considerable time to peruse such products while they wait for their food. Given the size of their containers, however, many single-serve products, such as sugar and other condiments, generally have only a small area available for imprinting a message.

For example, conventional single-serve sugar and sugar-substitutes typically are packaged in three-side and four-side seal pouch containers measuring approximately 1.75" by 3.75", or less, or in wrap-style pouch containers measuring approximately 0.75" by 4.5", or less, thereby providing less than about 13.1 $in^2$ of imprintable area on the faces of the pouches. Single-serve ketchup, mustard, and other sauces and condiments typically are packaged in three-side and four-side seal pouch containers measuring approximately 2.0" by 3.75", or less, thereby providing less than about 15.0 $in^2$ of imprintable area. Single serve crackers typically are packaged in wrap-style pouch containers measuring approximately 2.5" by 4", or less, with an imprintable area of less than 20 $in^2$. Pouch containers of such sizes have very limited imprintable area and are poorly suited to much more than very simple branding messages, such as an advertisers' name, slogan, or logo.

In particular, as a practical matter it is impossible to provide a redeemable manufacturer coupon on many such pouch containers because of size constraints. A manufacturer typically will include a bar code that is machine readable and used in systems that manage accounting between a coupon issuer and a merchant who honors the coupon. The size of such bar codes must be sufficiently large so that it may be easily and accurately read, but in doing so, there is little or no room left on a traditional message slip to associate an advertising message with the bar code.

In contrast, the novel containers may be fabricated with pouches having sizes essentially the same as conventional containers, but with significantly greater imprintable area because they comprise a message section as well. For example, packaging sugar in novel packets such as container 10 with conventionally sized 3 or 4-side seal pouch can provide 50% more imprintable area by providing a single message section about half the size of the pouch face. Alternately, the same container may be provided with two message sections each having approximately the same dimensions as the face of the pouch section. Thus, the message sections would provide four imprintable faces and ample room for even two redeemable manufacture coupons. One face of each message section could be used for imprinting an advertising message that will inform a consumer of the basic terms of the coupon, and the other face for imprinting a suitable bar code. At the same time, because the message sections may be folded over the pouch, the novel container occupies very little more space than conventional sugar packs and may be dispensed in containers used to dispense conventional sugar packs.

Other examples are set forth in Table 1. Table 1 shows the increase in imprintable area that is provided for by the novel containers in various preferred sizes and configurations where the pouch is either a 3 or 4-sided seal ("Standard") or a 3-sided seal wrap-style ("Wrap) with message sections being either one half, equal to, or twice the size of a face of the pouch.

TABLE 1

| Pouch Style | Pouch Face Dimensions (in × in) | Pouch Face Imprintable Area ($in^2$) | Number of Message Sections | Message Section Imprintable Area (PF Imprintable Area) | Total Imprintable Area ($in^2$) | Increase in Imprintable Area (%) |
|---|---|---|---|---|---|---|
| Standard | 1.75 × 3.75 | 13.1 | 1 | 0.5 | 19.7 | 50 |
| Standard | 1.75 × 3.75 | 13.1 | 1 | 1.0 | 26.2 | 100 |
| Standard | 1.75 × 3.75 | 13.1 | 2 | 1.0 | 39.4 | 200 |
| Standard | 1.75 × 3.75 | 13.1 | 1 | 2.0 | 39.4 | 200 |
| Standard | 2 × 3.75 | 15.0 | 1 | 0.5 | 22.5 | 50 |
| Standard | 2 × 3.75 | 15.0 | 1 | 1.0 | 30.0 | 100 |
| Standard | 2 × 3.75 | 15.0 | 2 | 1.0 | 45.0 | 200 |
| Standard | 2 × 3.75 | 15.0 | 1 | 2.0 | 45.0 | 200 |
| Wrap | 2.5 × 4 | 20.0 | 1 | 0.5 | 30.0 | 50 |
| Wrap | 2.5 × 4 | 20.0 | 2 | 0.5 | 40.0 | 100 |
| Wrap | 2.5 × 4 | 20.0 | 2 | 1.0 | 60.0 | 200 |

Preferably the bar code imprinted on the message section meets standards for UPC bar codes utilizing the UCC/EAN-128 Article Numbering System as are known in the industry, but other information may be encoded therein. It also will be appreciated that other machine readable indicia may be provided in association with the coupon or other advertising message, such as suitably encoded magnetic media films, provided they are acceptable for use in association with food products.

Moreover, in conventional pouch containers, the pouch and whatever advertising message may be imprinted thereon is considered trash once the pouch is opened. When the product is a liquid, paste or any other product that leaves a residue, the consumer may take great pains to avoid further contact with the pouch. The novel containers, however, provide a message area that is never in contact with the product and which is separable from the pouch without opening the pouch. Thus, the consumer is provided with, for example, a neat clean coupon that he or she may eventually redeem, all without encountering any messy residues.

It also will be appreciated that the novel containers may be produced by making relatively minor modifications to conventional processes and machinery for making pouch containers. Such machinery includes horizontal and vertical form, fill and seal machinery for packaging a variety of products and manufactures of such equipment include Winpak Ltd., Winnipeg, Manitoba, Canada, Prodo-Pak Corporation, Garfield, N.J., U.S.A., Circle Packaging Machinery Inc., Green Bay, Wis., U.S.A.; Cloud L.L.C., Des Plaines, Ill., U.S.A.; Ropak Manufacturing Company, Inc., Decatur, Ala., U.S.A.

The methods of the subject invention are directed to disseminating advertising messages to consumers. The novel methods comprise packaging a product in a pouch container having an advertising message associated therewith which may be viewed by a consumer, the pouch container being one of the novel pouch containers. That is, the containers are selected from the group consisting of the novel containers described herein or any subgroup thereof. The packaged product with the advertising message is distributed to a consumer outlet and then distributed to consumers associated with the consumer outlet. The advertising message is thereby distributed to consumers of the product.

It is especially preferred that the novel pouch containers be used to distribute single-serve food products distributed to consumer outlets such as restaurants, concessions, institutions, and other food service establishments. It will be appreciated that consumers in such outlets often have a greater opportunity to view advertising messages while they wait for and consume food. It is expected, therefore, that the view rates for messages distributed via the novel methods will be significantly greater than view rates for other types of direct advertising.

The subject invention also provides for novel methods for packaging and distributing products for dissemination to a target consumer group. Those methods comprise packing a product in a pouch container having associated therewith an advertising message pertaining to products or services other than the packaged product, the advertising message being intended for a target consumer group. The packaged product then is packaged in a shipping carton having a machine readable indicator uniquely associated with the advertising message. The indicator then is read and, in response to the reading, the carton containing the packaged product is shipped to consumer outlets associated with the target consumer group. The advertising message then may be disseminated to the target consumer group through the consumer outlets.

The novel methods are particularly suitable for distributing single-serve food products packaged in the novel pouch containers through restaurants, concessions, institutions and other food service establishments. Consumers in such establishments typically have a greater opportunity to view advertisements while they are waiting for or consuming their food. It is expected, therefore, that such advertising campaigns will have relatively higher view and response rates as compared to many conventional direct advertising methods.

For example, an advertiser may wish to limit its campaign to consumers in a specific geographical area or associated with specific types of consumer outlets. A code or other indicator may be assigned to that message and stored in a machine readable format or medium which is printed, affixed, or otherwise associated with the shipping carton for products containing the advertiser's message. The indicator then may be read so that the product will be shipped only to consumer outlets in the geographic area or of the particular type targeted by the advertiser.

The shipping cartons may be any carton suitable for shipping the packaged product and many such cartons are known and currently in use. Likewise, the machine readable indicator, and the apparatus for reading such indicators, may be selected from any such systems as are known in the art For example, the indicator could be a bar code readable by conventional bar code readers. Alternately, the indicator could be text or numerical code that may be scanned and interpreted by conventional scan readers. The indicator also could be encoded on a microchip, magnetic strip, or other media for recording data. Other systems for storing and reading an indicator are known and may be used if desired.

It will be appreciated, therefore, that the novel methods allow for efficient and effective dissemination of advertising messages to targeted consumers.

While this invention has been disclosed and discussed primarily in terms of specific embodiments thereof, it is not intended to be limited thereto. Other modifications and embodiments will be apparent to the worker in the art.

What is claimed is:

1. A method for disseminating manufacturer coupons to a target consumer group, which method comprises:

(a) packaging a product in a pouch container having associated therewith a manufacturer coupon pertaining to products or services other than said packaged product, wherein said packaged product is a single-serve food product, wherein said manufacturer coupon is redeemable by a consumer of said product and includes machine readable code associated therewith to facilitate automated processing of said coupon, and said manufacturer coupon is intended for a target consumer group;

(b) packaging said packaged product in a shipping carton having a machine readable indicator assigned to said manufacturer coupon;

(c) reading said indicator and in response thereto shipping said carton to consumer food service outlets associated with said target consumer group, whereby said packaged single-serve food product may be distributed to consumers thereby disseminating said manufacturer coupon.

2. The method of claim 1, wherein said consumer food service outlet is a restaurant.

3. The method of claim 1, wherein said product is selected from the group consisting of single-serve sugar, sugar substitutes, salt, salt substitutes, pepper, ketchup, mayonnaise, mustard, sauces, and crackers.

4. The method of claim 1, wherein said product is a single-serve condiment.

5. The method of claim 1, wherein said manufacturer coupon includes a bar code associated therewith.

6. The method of claim 1, wherein said manufacturer coupon includes a UPC bar code utilizing the UCC/EAN-128 Article Numbering System.

7. The method of claim 1, wherein said pouch container comprises one or more flexible imprintable substrate sheets; wherein said substrate sheets comprise collectively:

(a) one or more pouch sections defining a sealed volume accommodating a product therein, said pouch sections being provided on one or more of said substrate sheets; and (b) a message section providing a substrate on which said manufacturer coupon is imprinted, said message section being provided on one of said substrate sheets and being connected to at least one of said pouch sections;

(c) wherein said message section is separable from said pouch sections without compromising the integrity of said sealed volume, whereby said manufacturer coupon may be removed from said sealed volume and redeemed by a consumer.

8. The method of claim 1, wherein said pouch container comprises a substrate sheet providing at least one said pouch section and said message section, wherein said message section is separable from said pouch section by cutting or tearing said substrate sheet along the boundary between said pouch and message sections.

9. The method of claim 1, wherein said pouch container comprises one or more pouch substrate sheets providing said pouch sections and a message substrate sheet providing said message section, wherein said message sheet is removably affixed to the exterior surface of one of said pouch sheets.

10. The method of claim 1, wherein said pouch container is produced by folding and sealing a continuous web to provide a plurality of pouch containers connected to each other by said web and by cutting the web interconnecting said pouch containers to provide individual product units containing at least one pouch container.

11. The method of claim 1, wherein said pouch container is produced by sealing two continuous webs together to provide a plurality of pouch containers connected to each other by said webs and by cutting said webs interconnecting said pouch containers to provide individual product units containing at least one pouch container.

12. The method of claim 1, wherein said pouch container comprises a flexible imprintable substrate sheet; wherein:

(a) said substrate sheet comprises one or more pouch sections and at least one message section adjacent to a pouch section;

(b) wherein said substrate sheet is folded longitudinally such that the boundaries of said pouch sections overlap, the boundaries of said pouch sections being sealed together to define a sealed volume accommodating said product therein with said message section extending from a sealed boundary of said pouch section;

(c) wherein said message section provides a substrate on which said manufacturer coupon is imprinted for viewing by a consumer of said product; and (d) wherein said message section is separable from said pouch section and the sealed volume defined by said pouch section without compromising the integrity of said sealed volume to enable a consumer to redeem said manufacturer coupon.

13. The method of claim 12, wherein (a) said substrate sheet comprises a single, rectangular pouch section and a message section extending from a side thereof; and (b) wherein said substrate sheet is folded in half along a line passing through said pouch section parallel to said side from which said message section extends to provide two rectangular, overlaid folds, and the boundaries of said pouch section are sealed to define a generally rectangular-shaped sealed volume with said message section extending from the side of said sealed volume opposite said fold line.

14. The method of claim 12, wherein:

(a) said substrate sheet comprises two generally rectangular pouch sections and a message section extending between said pouch sections;

(b) wherein said substrate sheet is folded along a line passing through said message section such that said two pouch sections overlay each other and said pouch sections are sealed at the boundaries thereof to define a generally rectangular-shaped sealed volume with said message section extending from the side of said sealed volume proximate to said fold line.

15. The method of claim 12, wherein:

(a) said substrate sheet comprises a generally rectangular pouch section and a message section extending from a side thereof; and (b) wherein said substrate sheet is folded in half along a line passing through said pouch section and said message section to provide two rectangular, overlaid folds, and the boundaries of said pouch section are sealed to define a generally rectangular-shaped sealed volume with said message section extending from a side of said sealed volume adjacent to said fold line.

16. The method of claim 12, wherein:

(a) wherein said substrate sheet comprises a single, rectangular pouch section and a message section extending from a side thereof; and (b) wherein said substrate sheet is folded along two longitudinal fold lines passing through said pouch section parallel to said side from which said message section extends to provide two rectangular folds overlaying a third rectangular fold and the boundaries of said pouch section are sealed to define a generally rectangular-shaped sealed volume with said message section extending from a face of said pouch section.

17. The method of claim 12, wherein:

(a) wherein said substrate sheet comprises a single, rectangular pouch section and a message section extending from a boundary thereof; and (b) wherein said substrate sheet is folded along two fold lines passing through said pouch section to provide two rectangular folds overlaying a third rectangular fold and the boundaries of said pouch section are sealed to define a generally rectangular-shaped sealed volume with said message section extending from a transverse seal of said pouch section.

18. The method of claim 1, wherein said pouch container comprises two flexible imprintable substrate sheets; wherein:

(a) said substrate sheets each comprise a pouch section and at least one of said substrate sheets comprises a message section adjacent to said pouch section thereon;

(b) wherein said pouch sections are superimposed on each other and sealed at the boundaries thereof to define a sealed volume accommodating said product therein;

(c) wherein said message section provides a substrate on which said manufacturer coupon is imprinted for viewing by a consumer of said product; and (d) wherein said message section is separable from said pouch section and the sealed volume defined by said pouch section without compromising the integrity of said sealed volume to enable a consumer to redeem said manufacturer coupon.

19. The method of claim 1, wherein said pouch container comprises:

(a) one or two pouch sheets composed of a flexible imprintable substrate and defining a sealed volume accommodating said product; and (b) a message sheet composed of an imprintable substrate, said message sheet being affixed to at least one of said pouch sheets on an exterior surface thereof and providing a substrate on which said manufacturer coupon is imprinted for viewing by a consumer of said product;

(c) wherein said message sheet is separable from said pouch sheets and the sealed volume defined thereby without compromising the integrity of said sealed volume to enable a consumer to redeem said manufacturer coupon.

20. The method of claim 19, wherein said pouch container comprises one pouch sheet, said pouch sheet being folded such that portions thereof overlay each other and said overlaid portions are sealed at the boundaries thereof to define a sealed volume accommodating said product therein.

21. The method of claim 19, wherein said pouch container comprises two pouch sheets, said pouch sheets being superimposed on each other and sealed at the boundaries thereof to define a sealed volume accommodating said product therein.

22. The method of claim 19, wherein said pouch container comprises one pouch sheet, wherein said pouch sheet is folded along two longitudinal fold lines and the boundaries of said pouch sheet are sealed to define a sealed volume accommodating said product therein.

23. The method of claim 1, wherein said pouch container comprises:

(a) one or two pouch sheets composed of a flexible imprintable substrate sheets and defining a sealed volume accommodating said product, (b) wherein at least one of said pouch sheets is comprised by a laminate sheet comprising said pouch sheet and a message sheet, said message sheet being composed of an imprintable substrate and providing a substrate on which said manufacturer coupon is imprinted for viewing by a consumer of said product; and (c) wherein said message sheet is separable from said laminate sheet and the sealed volume defined by said pouch sheets without compromising the integrity of said sealed volume to enable a consumer to redeem said manufacturer coupon.

24. The method of claim 23, wherein said pouch container comprises:

(a) a laminate sheet comprising a pouch sheet and a message sheet:

(b) wherein said laminate sheet is folded such that the boundaries of said pouch sheet overlap and are sealed together to define a sealed volume accommodating said product within said pouch substrate sheet.

25. The method of claim 23, wherein said pouch container comprises:

(a) two pouch sheets, wherein at least one of said pouch sheets is comprised by a laminate sheet comprising said pouch sheet and said message sheet; and (b) wherein said pouch sheets are superimposed such that the boundaries of said pouch sheets overlap and are sealed together to define a sealed volume accommodating said product with said pouch sheets.

* * * * *